US008909079B2

(12) United States Patent
Aoki et al.

(10) Patent No.: US 8,909,079 B2
(45) Date of Patent: Dec. 9, 2014

(54) IMAGE FORMING APPARATUS

(75) Inventors: Shinji Aoki, Kanagawa (JP); Haruo Iimura, Kanagawa (JP); Yasuhiko Ogino, Kanagawa (JP); Keigo Nakamura, Kanagawa (JP); Masahide Nakaya, Kanagawa (JP); Tomokazu Takeuchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 306 days.

(21) Appl. No.: 13/207,803

(22) Filed: Aug. 11, 2011

(65) Prior Publication Data

US 2012/0045237 A1 Feb. 23, 2012

(30) Foreign Application Priority Data

Aug. 20, 2010 (JP) ..... 2010-185592

(51) Int. Cl.
*G03G 15/16* (2006.01)

(52) U.S. Cl.
CPC .... *G03G 15/1675* (2013.01); *G03G 2215/0129* (2013.01)
USPC ..... 399/66

(58) Field of Classification Search
USPC ..... 399/66
See application file for complete search history.

(56) References Cited

U.S. PATENT DOCUMENTS

| | | | | |
|---|---|---|---|---|
| 4,962,307 | A | 10/1990 | Nakaya | |
| 5,132,869 | A | 7/1992 | Nakaya | |
| 5,142,329 | A | 8/1992 | Nakaya | |
| 5,595,852 | A | 1/1997 | Shimoda et al. | |
| 5,918,086 | A * | 6/1999 | Nakano et al. | 399/66 |
| 6,284,424 | B1 | 9/2001 | Iimura et al. | |
| 6,393,229 | B1 * | 5/2002 | Toyohara | 399/50 |
| 6,405,000 | B1 | 6/2002 | Nakaya | |
| 7,127,189 | B2 | 10/2006 | Takamatsu et al. | |
| 7,236,714 | B2 | 6/2007 | Sato et al. | |
| 7,269,368 | B2 | 9/2007 | Sato et al. | |
| 7,579,716 | B2 | 8/2009 | Sato et al. | |
| 7,662,530 | B2 | 2/2010 | Iimura | |
| 7,693,440 | B2 | 4/2010 | Sato et al. | |

(Continued)

FOREIGN PATENT DOCUMENTS

| | | |
|---|---|---|
| JP | 6-289682 | 10/1994 |
| JP | 10-268674 | 10/1998 |

(Continued)

OTHER PUBLICATIONS

U.S. Appl. No. 07/456,783, filed Dec. 28, 1989, Masahide, Nakaya.

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

An image forming apparatus includes a transfer bias generator including a transfer bias supply that supplies a transfer bias to a transfer nip formed between an image carrier and a first rotary body, and a controller that detects a toner adhesion amount at a predetermined region of the image carrier located immediately upstream from the transfer nip and having a predetermined length in a moving direction of the image carrier. The transfer bias generator outputs at least an alternating current component under one of constant voltage control and constant current control and changes a target output value of the alternating current component according to the toner adhesion amount detected by the controller.

22 Claims, 18 Drawing Sheets

(56) References Cited

U.S. PATENT DOCUMENTS

| | | | | |
|---|---|---|---|---|
| 7,913,098 | B2 | 3/2011 | Nakaya | |
| 2003/0072585 | A1* | 4/2003 | Nakazawa et al. | 399/113 |
| 2005/0063723 | A1* | 3/2005 | Comstock et al. | 399/66 |
| 2005/0189923 | A1 | 9/2005 | Ohishi et al. | |
| 2007/0059016 | A1 | 3/2007 | Sato et al. | |
| 2007/0178398 | A1 | 8/2007 | Ogino et al. | |
| 2008/0145084 | A1* | 6/2008 | Toizumi et al. | 399/66 |
| 2008/0187857 | A1 | 8/2008 | Ogino et al. | |
| 2009/0123168 | A1* | 5/2009 | Aoki et al. | 399/66 |
| 2009/0142087 | A1 | 6/2009 | Iimura | |
| 2010/0098446 | A1 | 4/2010 | Ishikawa et al. | |
| 2010/0226697 | A1 | 9/2010 | Ogino | |
| 2010/0232820 | A1 | 9/2010 | Usami et al. | |
| 2010/0284705 | A1 | 11/2010 | Aoki et al. | |
| 2011/0058831 | A1 | 3/2011 | Usami et al. | |
| 2011/0131434 | A1 | 6/2011 | Nakaya | |
| 2011/0181116 | A1 | 7/2011 | Takeuchi et al. | |
| 2011/0200348 | A1 | 8/2011 | Aoki | |
| 2011/0229168 | A1 | 9/2011 | Shiraishi et al. | |
| 2011/0255892 | A1 | 10/2011 | Aoki | |

FOREIGN PATENT DOCUMENTS

| | | |
|---|---|---|
| JP | 3340221 | 8/2002 |
| JP | 2002-307737 | 10/2002 |
| JP | 2006-267486 | 10/2006 |
| JP | 2007-57902 A | 3/2007 |
| JP | 2010-139811 A | 6/2010 |

* cited by examiner

IMAGE FORMING APPARATUS

CROSS-REFERENCE TO RELATED APPLICATIONS

This patent application is based on and claims priority pursuant to 35 U.S.C. §119 to Japanese Patent Application No. 2010-185592, filed on Aug. 20, 2010, in the Japan Patent Office, the entire disclosure of which is hereby incorporated herein by reference.

FIELD OF THE INVENTION

The present invention relates to an image forming apparatus which transfers a toner image on an image carrier onto a recording medium nipped in a transfer nip formed by rotary contact between the image carrier and a contiguous nip-forming rotary body.

BACKGROUND OF THE INVENTION

There is known a background image forming apparatus which forms a toner image on a surface of a drum-shaped photoconductor through a well-known electrophotographic process.

The structural configuration of such an apparatus is as follows. An endless intermediate transfer belt is brought into contact with the photoconductor to form a primary transfer nip. In the primary transfer nip, the toner image on the photoconductor is primarily transferred onto the intermediate transfer belt. A secondary transfer roller is brought into contact with the intermediate transfer belt to form a secondary transfer nip. In the loop of the intermediate transfer belt, a secondary transfer opposite roller is disposed. The intermediate transfer belt is nipped between the secondary transfer opposite roller and the above-described secondary transfer roller. The secondary transfer opposite roller disposed inside the loop is grounded. By contrast, a secondary transfer bias is applied to the secondary transfer roller disposed outside the loop. Between the secondary transfer opposite roller and the secondary transfer roller, therefore, a secondary transfer electric field is generated which electrostatically moves the toner image from the side of the secondary transfer opposite roller toward the side of the secondary transfer roller. With the action of the secondary transfer electric field and nip pressure, the toner image on the intermediate transfer belt is secondarily transferred onto a recording sheet conveyed into the secondary transfer nip in synchronization with the toner image on the intermediate transfer belt.

In the above-described configuration, with recording media with substantial surface roughness, such as a Japanese paper sheet, an uneven toner image density pattern conforming to the surface roughness tends to be formed in the toner image, owing to a failure to transfer a sufficient amount of toner to recesses in the surface of the sheet.

Accordingly, the background image forming apparatus employs, as the secondary transfer bias, a superimposed bias including an alternating current (AC) voltage component superimposed on a direct current (DC) voltage component, instead of a bias including only a DC voltage. It has been shown experimentally that it is possible to minimize the formation of an uneven density pattern with the application of the above-described secondary transfer bias, as compared with the application of the secondary transfer bias including only the DC voltage.

However, the present inventors have found from experiments that there are cases in which a sufficient image density fails to be obtained in the recesses in a sheet surface, even with application of a superimposed bias as the secondary transfer bias. It was also found that, even if a sufficient image density is successfully obtained in the recesses, a plurality of white spots appear in an image area corresponding to the recesses.

Upon closer inspection, the present inventors found the following phenomenon, described below with reference to FIGS. 1 and 2.

FIG. 1 is an enlarged configuration diagram of a related art image forming apparatus 530 illustrating an example of the secondary transfer nip. In the drawing, an intermediate transfer belt 531 is pressed against a nip formation roller 536 by a secondary transfer inner surface roller 533 in contact with the inner surface of the intermediate transfer belt 531. With this pressing, a secondary transfer nip is formed in which the outer surface of the intermediate transfer belt 531 and the nip formation roller 536 come into contact with each other. A toner image on the intermediate transfer belt 531 is secondarily transferred onto a recording sheet P conveyed into the secondary transfer nip. The secondary transfer bias for secondarily transferring the toner image is applied to one of the two rollers illustrated in the drawing, and the other roller is electrically grounded. It is possible to transfer the toner image onto the recording sheet P, irrespective of to which of the rollers the transfer bias is applied.

Herein, a description is given of a case of applying the secondary transfer bias to the secondary transfer inner surface roller 533 and using toner of negative polarity. In this case, to move the toner in the secondary transfer nip from the side of the secondary transfer inner surface roller 533 toward the side of the nip formation roller 536, a bias having a time-averaged electrical potential of the same negative polarity as the polarity of the toner is applied as the secondary transfer bias including a superimposed bias.

FIG. 2 is a waveform chart illustrating an example of a waveform of the secondary transfer bias including a superimposed bias and applied to the secondary transfer inner surface roller 533. In the drawing, an offset voltage Voff in volts (V) represents the time-averaged value of the secondary transfer bias. As illustrated in the drawing, the secondary transfer bias including a superimposed bias has a sinusoidal waveform, and includes a positive peak value and a negative peak value. A reference sign Vt represents one of the two peak values for moving the toner in the secondary transfer nip from the belt side toward the recording sheet side, i.e., the negative peak value in the present example (hereinafter referred to as the transferring peak value Vt). A reference sign Vr represents the other peak value for returning the toner from the recording sheet side toward the belt side, i.e., the positive peak value in the present example (hereinafter referred to as the returning peak value Vr). Vpp represents the peak-to-peak voltage.

Even if an AC bias including only an AC component is applied instead of the superimposed bias as illustrated in the drawing, it is possible to move the toner back and forth between the intermediate transfer belt 531 and the recording sheet P in the secondary transfer nip. The AC bias, however, simply moves the toner back and forth, and is unable to transfer the toner onto the recording sheet P. If a superimposed bias including a DC component is applied to adjust the offset voltage Voff, i.e., the time-averaged value of the superimposed bias, to the same negative polarity as the polarity of the toner, it is possible to cause the toner to relatively move from the belt toward the recording sheet P during the back-and-forth movement thereof, and thereby to transfer the toner onto the recording sheet P.

The present inventors have observed the behavior of the toner in the secondary transfer nip in the above-described configuration, and found that, when the secondary transfer bias including a superimposed bias starts being applied, only a very small number of toner particles present on the surface of a toner layer on the intermediate transfer belt 531 first separates from the toner layer and moves toward recesses in the surface of the recording sheet P. Most of the toner particles present in the toner layer remain therein. The very small number of toner particles having separated from the toner layer enters the recesses in the surface of the recording sheet P. Thereafter, if the direction of the electric field is reversed, the toner particles return from the recesses to the toner layer. In this process, the returning toner particles collide with the other toner particles remaining in the toner layer, and reduce the adhesion of the other toner particles to the toner layer. Then, in the next reversal of the direction of the electric field to the direction for moving toner particles toward the recording sheet P, a larger number of toner particles than in the first cycle separates from the toner layer and moves toward the recesses in the surface of the recording sheet P. As the above-described sequence is repeated, the number of toner particles separating from the toner layer and entering the recesses in the surface of the recording sheet P is gradually increased. Consequently, a sufficient amount of toner particles is eventually transferred into the recesses.

However, it was found that, if the toner adhesion amount in the toner layer is relatively large, it is difficult for the returning peak value Vr illustrated in FIG. 2 to cause the toner particles transferred into the recesses in the surface of the recording sheet P to return to the toner layer on the intermediate transfer belt 531, and that this difficulty results in a deficiency in image density in the recesses. It was also found that, if the toner adhesion amount in the toner layer is relatively small, white spots tend to appear in the image in the area of the recesses in the surface of the recording sheet P, when the secondary transfer bias reaches the transferring peak value Vt. For example, the potential difference between the secondary transfer inner surface roller 533 and the nip formation roller 536 illustrated in FIG. 1 reaches its maximum when the secondary transfer bias reaches the transferring peak value Vt. In this state, discharge tends to occur from the side of the secondary transfer inner surface roller 533 toward the side of the nip formation roller 536 in the recesses in the surface of the recording sheet P. In this case, if the toner adhesion amount in the toner layer is relatively large, toner particles having a polarity that is the opposite of the polarity of the transferring peak value Vt are present between the secondary transfer inner surface roller 533 and the recording sheet P. Therefore, the above-described discharge is minimized. Meanwhile, if the toner adhesion amount in the toner layer is relatively small, there are fewer toner particles opposite in polarity to the transferring peak value Vt and present between the secondary transfer inner surface roller 533 and the recording sheet P. Therefore, the above-described discharge occurs. As a result, the toner particles oppositely charged by the discharge are hardly transferred into the recesses in the surface of the recording sheet P, and a multitude of white spots appear in the image in the image area of the recesses in the surface of the recording medium.

BRIEF SUMMARY OF THE INVENTION

The present invention describes a novel image forming apparatus that includes an image carrier, a first rotary body, a second rotary body, and a transfer bias generator. The image carrier is movable in a predetermined moving direction and carries a toner image. The first rotary body contacts an outer surface of the image carrier. The second rotary body is pressed against an inner surface of the image carrier to form a transfer nip between the outer surface of the image carrier and the first rotary body. The transfer bias generator outputs to the second rotary body a transfer bias including a direct current component and an alternating current component for application to the image carrier to transfer the toner image from the image carrier onto a recording medium conveyed through the transfer nip. The transfer bias generator includes a transfer bias supply operatively connected to the second rotary body to supply the transfer bias including at least the alternating current component thereto. The transfer bias generator further includes a controller operatively connected to the transfer bias supply to detect a toner adhesion amount at a predetermined region of the image carrier located immediately upstream from the transfer nip and having a predetermined length in the moving direction of the image carrier. The transfer bias generator outputs at least the alternating current component under one of constant voltage control and constant current control and changes a target output value of the alternating current component according to the toner adhesion amount detected by the controller.

The present invention further describes a novel image forming apparatus that includes an image carrier, a first rotary body, a second rotary body, and a transfer bias generator. The image carrier is movable in a predetermined moving direction and carries a toner image. The first rotary body contacts an outer surface of the image carrier. The second rotary body is pressed against an inner surface of the image carrier to form a transfer nip between the outer surface of the image carrier and the first rotary body. The transfer bias generator outputs to the second rotary body a transfer bias including a direct current component and an alternating current component for application to the image carrier to transfer the toner image from the image carrier onto a recording medium conveyed through the transfer nip. The transfer bias generator includes a transfer bias supply operatively connected to the second rotary body to supply the transfer bias including at least the alternating current component thereto. The transfer bias generator further includes a controller operatively connected to the transfer bias supply to detect a toner adhesion amount at a predetermined region of the image carrier located immediately upstream from the transfer nip and having a predetermined length in the moving direction of the image carrier. The transfer bias generator outputs both the direct current component and the alternating current component under one of constant voltage control and constant current control, and changes a target output value of the alternating current component and a target output value of the direct current component according to the toner adhesion amount detected by the controller.

The present invention further describes a novel image forming apparatus that includes an image carrier, a first rotary body, a second rotary body, and a transfer bias generator. The image carrier is movable in a predetermined moving direction and carries a toner image. The first rotary body contacts an outer surface of the image carrier. The second rotary body is pressed against an inner surface of the image carrier to form a transfer nip between the outer surface of the image carrier and the first rotary body. The transfer bias generator outputs a transfer bias including a direct current component and an alternating current component for application to the image carrier to transfer the toner image from the image carrier onto a recording medium conveyed through the transfer nip. The transfer bias generator includes a transfer bias supply operatively connected to one of the first rotary body and the second rotary body to supply the transfer bias thereto, and including a first power supply that generates the direct current component for supply to one of the first rotary body and the second rotary body, and a second power supply that generates the alternating current component for supply to the other one of the first rotary body and the second rotary body. The transfer bias generator further includes a controller operatively connected to the transfer bias supply to detect a toner adhesion amount at a predetermined region of the image carrier located immediately upstream from the transfer nip and having a predetermined length in the moving direction of the image carrier. The transfer bias generator outputs at least the alternating current component under one of constant voltage control and constant current control, and changes a target output value of the alternating current component according to the toner adhesion amount detected by the controller.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
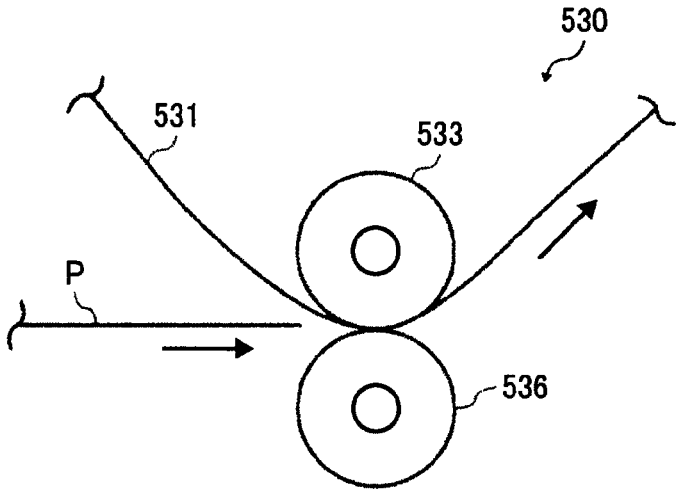
FIG. 1 RELATED ART
FIG. 1 is an enlarged configuration diagram of a related art image forming apparatus.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, a first embodiment of an electrophotographic color printer 301 (hereinafter simply referred to as the printer 301) will be described as an image forming apparatus according to an embodiment of the present invention.

Figure 3:
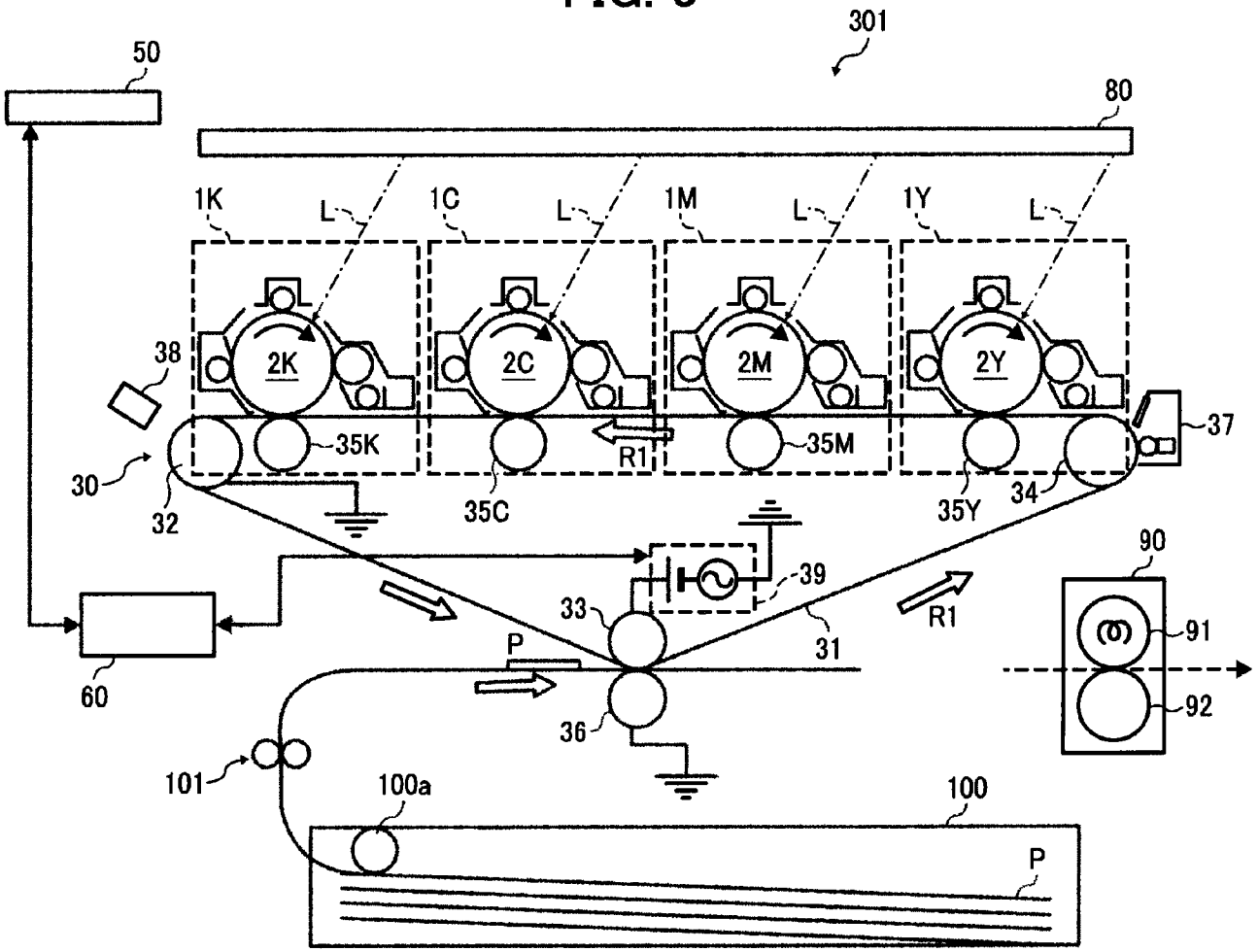
FIG. 3 is a schematic configuration diagram illustrating a printer according to a first embodiment.

A basic configuration of the printer 301 according to the first embodiment will be first described. FIG. 3 is a schematic configuration diagram illustrating the printer 301 according to the first embodiment. In the drawing, the printer 301 according to the first embodiment includes four image forming units 1Y, 1M, 1C, and 1K for forming toner images of yellow, magenta, cyan, and black (hereinafter referred to as Y, M, C, and K, respectively) colors, a transfer unit 30 serving as a transfer device, an optical writer 80, a fixing device 90, a paper tray 100, a registration roller pair 101, a control panel 50, a controller 60, and so forth.

Figure 4:
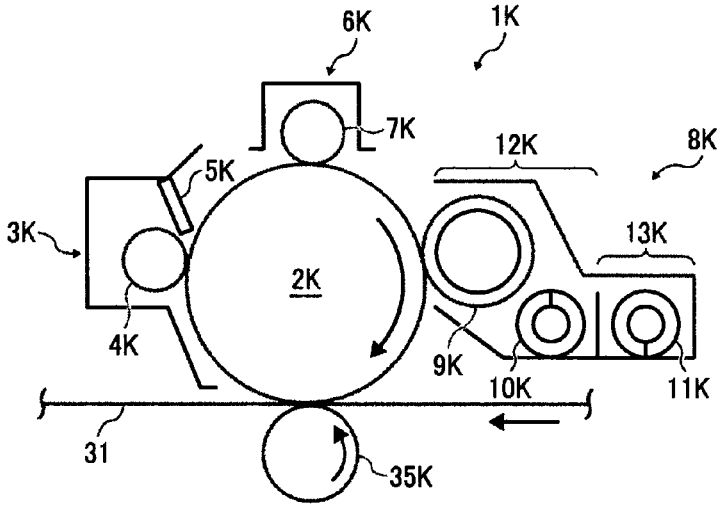
FIG. 4 is an enlarged configuration diagram illustrating an enlarged vertical sectional view of an image forming unit for black color provided in the printer shown in FIG. 3.

The four image forming units 1Y, 1M, 1C, and 1K use, as image forming material, Y, M, C, and K toners, respectively, which are different in color from one another. Except for the difference in color, the image forming units 1Y, 1M, 1C, and 1K are similar in configuration, and are replaced by new image forming units when the life thereof expires. For example, as shown in FIG. 4 illustrating a vertical sectional view of the image forming unit 1K, the image forming unit 1K for forming a K toner image includes a drum-shaped photoconductor 2K serving as a latent image carrier, a photoconductor cleaner 3K, a discharger, a charger 6K, a development device 8K, and so forth. The above-described components are held in a common holder to be detachably attached to a body of the printer 301 as a unit. It is thereby possible to replace the components at the same time.

The photoconductor 2K is constructed of a drum-shaped base having an outer circumferential surface provided with an organic photosensitive layer, and is driven to rotate clockwise in the drawing by a driver. The photoconductor 2K has a diameter of approximately 60 mm and a capacitance of approximately 9.5E-7 F/$m^2$ (farads per square meter). In the charger 6K, a charging roller 7K supplied with a charging bias is brought into contact with or proximity to the photoconductor 2K to cause discharge between the charging roller 7K and the photoconductor 2K. Thereby, an outer circumferential surface of the photoconductor 2K is uniformly charged. In the printer 301, the surface of the photoconductor 2K is uniformly charged to the same negative polarity as a normal charge polarity of toner. Specifically, the surface of the photoconductor 2K is uniformly charged to approximately −650 V. As the charging bias, a DC voltage superimposed on an AC voltage is employed. The charging roller 7K is constructed of a metal core having an outer circumferential surface covered by a conductive elastic layer made of a conductive elastic material. The method of bringing a charging member, such as the charging roller 7K, into contact with or proximity to the photoconductor 2K may be replaced by a method using a charger.

The uniformly charged surface of the photoconductor 2K is subjected to optical scanning with laser light L emitted from the later-described optical writer 80 illustrated in FIG. 3, and carries an electrostatic latent image for the K color. The potential of the electrostatic latent image for the K color is approximately 100 V. The electrostatic latent image for the K color is developed into a K toner image by the development device 8K using K toner. Then, the K toner image is primarily transferred onto a later-described intermediate transfer belt 31 of the transfer unit 30. If the developed toner image is a full solid image, a toner adhesion amount per unit area M/A in the full solid image is in a range of from approximately 0.55 mg/$cm^2$ (milligrams per square centimeter) to approximately 0.65 mg/$cm^2$.

The photoconductor cleaner 3K removes post-transfer residual toner adhering to the surface of the photoconductor 2K after a primary transfer process, i.e., after the passage through a later-described primary transfer nip. The photoconductor cleaner 3K includes a cleaning brush roller 4K driven to rotate, and a cantilever-supported cleaning blade 5K having a free end brought into contact with the photoconductor 2K. The rotating cleaning brush roller 4K scrapes the post-transfer residual toner from the surface of the photoconductor 2K. Further, the cleaning blade 5K scrapes the post-transfer residual toner off the surface of the photoconductor 2K. The cleaning blade 5K is brought into contact with the photoconductor 2K in a counter direction in which the cantilever-supported end of the cleaning blade 5K is directed further downstream in the photoconductor rotation direction than the free end of the cleaning blade 5K.

The above-described discharger discharges residual charge remaining on the photoconductor 2K after the cleaning by the photoconductor cleaner 3K. With the discharging, the surface of the photoconductor 2K is initialized to prepare for the next image forming operation.

The development device 8K includes a development section 12K housing a development roll 9K, and a developer conveying section 13K for stirring and conveying a K developer. The developer conveying section 13K includes a first conveying chamber housing a first screw 10K, and a second conveying chamber housing a second screw 11K. Each of the first screw 10K and the second screw 11K includes a rotary shaft having opposite end portions in an axial direction thereof rotatably supported by respective shaft bearings, and a helical blade helically protruding from an outer circumferential surface of the rotary shaft.

The first conveying chamber housing the first screw 10K and the second conveying chamber housing the second screw 11K are separated by a dividing wall. The dividing wall has opposite end portions in the axial direction of the first screw 10K and the second screw 11K formed with communication ports through which the two conveying chambers communicate with each other. The first screw 10K is driven to rotate to stir, in a rotation direction thereof, the K developer held inside the helical blade, and conveys the K developer from the far side toward the near side in a direction perpendicular to the plane of the drawing. The first screw 10K and the later-described development roll 9K are arranged parallel to each other to face each other. In this case, therefore, a conveyance direction of the K developer extends along an axial direction of the development roll 9K. The first screw 10K supplies the K developer to an outer circumferential surface of the development roll 9K along the axial direction of the development roll 9K.

The K developer conveyed to the proximity of an end portion of the first screw 10K on the near side in the drawing enters the second conveying chamber through the communication port provided near the end portion of the dividing wall on the near side in the drawing. Thereafter, the K developer is held inside the helical blade of the second screw 11K. Then, as the second screw 11K is driven to rotate, the K developer is stirred in a rotation direction of the second screw 11K and conveyed from the near side toward the far side in the drawing.

In the second conveying chamber, a K toner concentration detection sensor is mounted on a lower wall of a casing of the development device 8K to detect the K toner concentration in the K developer in the second conveying chamber. A magnetic permeability sensor is employed as the K toner concentration detection sensor. The magnetic permeability of the K developer containing the K toner and magnetic carriers is correlated with the K toner concentration. Therefore, the magnetic permeability sensor detects the K toner concentration.

The printer 301 includes Y, M, C, and K toner replenishers for separately replenishing the Y, M, C, and K toners into the respective second conveying chambers of the development devices for the Y, M, C, and K colors. Further, the later-described controller 60 of the printer 301 stores, in a later-described RAM (Random Access Memory) 60*c* depicted in FIG. 9, a value Vtref for each of the Y, M, C, and K colors, which is the target value of the voltage output from each of the Y, M, C, and K toner concentration detection sensors. If the difference between the value of the voltage output from one of the Y, M, C, and K toner concentration detection sensors and the target value Vtref for the corresponding one of the Y, M, C, and K colors exceeds a predetermined value, the corresponding one of the Y, M, C, and K toner replenishers is driven for a length of time corresponding to that difference. Thereby, the second conveying chamber of the corresponding one of the development devices for the Y, M, C, and K colors is replenished with the corresponding one of the Y, M, C, and K toners.

The development roll 9K housed in the development section 12K is disposed opposite the first screw 10K, and is also disposed opposite the photoconductor 2K through an opening disposed in the casing. Further, the development roll 9K includes a cylindrical development sleeve constructed of a non-magnetic pipe and driven to rotate, and a magnet roller fixedly provided inside the development sleeve so as not to be rotated together with the development sleeve. With magnetic force generated by the magnet roller, the development roll 9K carries, on an outer circumferential surface of the development sleeve, the K developer supplied by the first screw 10K, and conveys the K developer to a development area disposed opposite the photoconductor 2K in accordance with the rotation of the development sleeve.

The development sleeve is supplied with a development bias, which is the same in polarity as the K toner and has a potential higher than the potential of the electrostatic latent image on the photoconductor 2K and lower than the potential of the uniformly charged surface of the photoconductor 2K. Between the development sleeve and the electrostatic latent image on the photoconductor 2K, therefore, a development electric potential arises which electrostatically moves the K toner on the development sleeve toward the electrostatic latent image. Meanwhile, between the development sleeve and the background area on the photoconductor 2K, a non-development electric potential arises which moves the K toner on the development sleeve toward the surface of the development sleeve. With the action of the development potential and the non-development potential, the K toner on the development sleeve is selectively transferred to the electrostatic latent image on the photoconductor 2K to develop the electrostatic latent image into the K toner image.

In FIG. 3 described above, the Y, M, and C toner images are also formed on the photoconductors 2Y, 2M, and 2C in the image forming units 1Y, 1M, and 1C for the Y, M, and C colors, in a manner similar to that of the image forming unit 1K for the K color.

Above the image forming units 1Y, 1M, 1C, and 1K, the optical writer 80 is provided which serves as a latent image writer. The optical writer 80 optically scans the photoconductors 2Y, 2M, 2C, and 2K with the laser light L emitted from laser diodes on the basis of image data transmitted from an external device, such as a personal computer. With the optical scanning, electrostatic latent images for the Y, M, C, and K colors are formed on the photoconductors 2Y, 2M, 2C, and 2K. Specifically, in the entire area on the uniformly charged surface of each of the photoconductors 2Y, 2M, 2C, and 2K, a portion applied with the laser light L has an attenuated potential. Thereby, an electrostatic latent image is formed in the portion applied with the laser light L, in which the potential is lower than in the other area, i.e., the background area. The optical writer 80 applies the laser light L emitted from a light source to each of the photoconductors 2Y, 2M, 2C, and 2K via a plurality of optical lenses and mirrors, while polarizing the laser light L in a main scanning direction with the use of a polygon mirror driven to rotate by a polygon motor. The optical writer 80 may perform optical writing with LED (Light-Emitting Diode) light emitted from a plurality of LEDs of an LED array.

Under the image forming units 1Y, 1M, 1C, and 1K, the transfer unit 30 is provided which serves as a transfer device for stretching and rotating the endless intermediate transfer belt 31 counterclockwise in FIG. 3 in a belt moving direction R1. The transfer unit 30 includes, in addition to the intermediate transfer belt 31 serving as an image carrier, a drive roller 32, a secondary transfer inner surface roller 33, a cleaning backup roller 34, four primary transfer rollers 35Y, 35M, 35C, and 35K, a nip formation roller 36, a belt cleaner 37, a potential sensor 38, and so forth.

The intermediate transfer belt 31 is stretched over the drive roller 32, the secondary transfer inner surface roller 33, the cleaning backup roller 34, and the four primary transfer rollers 35Y, 35M, 35C, and 35K, which are disposed inside the loop of the intermediate transfer belt 31. With rotational force of the drive roller 32 driven to rotate counterclockwise in the drawing by a driver, the intermediate transfer belt 31 is rotated counterclockwise in the belt moving direction R1. The intermediate transfer belt 31 includes an endless belt having the following characteristics: a thickness of approximately 60 μm, a volume resistivity of approximately 1e9 Ωcm (ohm centimeters) as measured by a Hiresta-UP MCP-HT450 resistivity meter manufactured by Mitsubishi Chemical Analytech Co., Ltd. with an applied voltage of approximately 100 V, and a modulus of elongation of at least approximately 2.0 GPa (gigs Pascals), for example, 2.6 GPa. Further, the intermediate transfer belt 31 is made of a carbon dispersed polyimide resin.

The rotating intermediate transfer belt 31 is nipped between the four primary transfer rollers 35Y, 35M, 35C, and 35K and the photoconductors 2Y, 2M, 2C, and 2K. Thereby, primary transfer nips for the Y, M, C, and K colors are formed in which an outer circumferential surface of the intermediate transfer belt 31 comes into contact with the photoconductors 2Y, 2M, 2C, and 2K. The primary transfer rollers 35Y, 35M, 35C, and 35K are supplied with a primary transfer bias by later-described primary transfer bias power supplies 81Y, 81M, 81C, and 81K depicted in FIG. 9. Thereby, primary transfer electric fields are generated between the Y, M, C, and K toner images on the photoconductors 2Y, 2M, 2C, and 2K and the primary transfer rollers 35Y, 35M, 35C, and 35K. In accordance with the rotation of the photoconductor 2Y for the Y color, the Y toner image formed on the surface of the photoconductor 2Y enters the primary transfer nip for the Y color. Then, with the action of the primary transfer electric field and nip pressure, the Y toner image is primarily transferred from the photoconductor 2Y onto the intermediate transfer belt 31. Thereafter, the intermediate transfer belt 31 having the Y toner image thus primarily transferred thereto sequentially passes the respective primary transfer nips for the M, C, and K colors. Then, the M, C, and K toner images on the photoconductors 2M, 2C, and 2K are sequentially primarily transferred onto the Y toner image in a superimposed manner. With this primary transfer of the toner images in the superimposed manner, a four-color superimposed toner image is formed on the intermediate transfer belt 31.

Each of the primary transfer rollers 35Y, 35M, 35C, and 35K includes an elastic roller constructed of a metal core with a conductive sponge layer fixed on an outer circumferential surface thereof. The primary transfer rollers 35Y, 35M, 35C, and 35K are arranged such that the respective axes thereof are shifted downstream in the belt moving direction R1 from the respective axes of the photoconductors 2Y, 2M, 2C, and 2K by approximately 2.5 mm. The thus-configured primary transfer rollers 35Y, 35M, 35C, and 35K are supplied with the primary transfer bias under constant current control. The primary transfer rollers 35Y, 35M, 35C, and 35K may be replaced by transfer chargers or transfer brushes.

The nip formation roller 36 of the transfer unit 30 is disposed outside the loop of the intermediate transfer belt 31. The intermediate transfer belt 31 is nipped between the nip formation roller 36, serving as a first rotary body, and the secondary transfer inner surface roller 33, serving as a second rotary body, disposed inside the loop of the intermediate transfer belt 31. Thereby, a secondary transfer nip is formed in which the outer circumferential surface of the intermediate transfer belt 31 and the nip formation roller 36 come into contact with each other. The nip formation roller 36 is grounded, and the secondary transfer inner surface roller 33 is supplied with a secondary transfer bias by a secondary transfer bias power supply 39 serving as a transfer bias supply. Between the secondary transfer inner surface roller 33 and the nip formation roller 36, therefore, a secondary transfer electric field is formed which electrostatically moves toner of negative polarity from the side of the secondary transfer inner surface roller 33 toward the side of the nip formation roller 36.

Below the transfer unit 30, the paper tray 100 is provided which stores a sheet bundle including a plurality of stacked recording sheets P. In the paper tray 100, the uppermost recording sheet P of the sheet bundle is made to come into contact with a sheet feeding roller 100*a*. The sheet feeding roller 100*a* is driven to rotate at a predetermined time to send the recording sheet P into a sheet feeding path. The registration roller pair 101 is provided near a lower end of the sheet feeding path. The registration roller pair 101 nips, between the two rollers thereof, the recording sheet P sent from the paper tray 100. Immediately thereafter, the rotation of the rollers is stopped. Then, the rollers are again driven to rotate at the time for causing the nipped recording sheet P to synchronize with the four-color superimposed toner image on the intermediate transfer belt 31 in the secondary transfer nip. Thereby, the recording sheet P is sent toward the secondary transfer nip. The toner images included in the four-color superimposed toner image on the intermediate transfer belt 31 brought into close contact with the recording sheet P in the secondary transfer nip are secondarily transferred onto the recording sheet P at the same time by the action of the secondary transfer electric field and nip pressure, and are formed into a full-color toner image with white color of the recording sheet P. The recording sheet P having the full-color toner image thus formed on a surface thereof passes the secondary transfer nip, and separates from the nip formation roller 36 and the intermediate transfer belt 31 owing to the curvatures of the nip formation roller 36 and the intermediate transfer belt 31.

The secondary transfer inner surface roller 33 includes a core and a conductive NBR (Acrylonitrile-Butadiene Rubber)-based rubber layer covering an outer circumferential surface of the core. A resistance R of the rubber layer is in a range of from approximately 1e6Ω to approximately 1e12Ω, preferably approximately 4e7Ω.

The nip formation roller 36 includes a core and a conductive NBR-based rubber layer covering an outer circumferential surface of the core. The resistance R of the rubber layer is approximately 1e6Ω or less.

The secondary transfer bias power supply 39 constituting a part of a transfer bias generator includes a DC power supply and an AC power supply, and is capable of outputting a DC voltage superimposed on an AC voltage as the secondary transfer bias. The configuration of applying the superimposed bias to the secondary transfer inner surface roller 33 and grounding the nip formation roller 36 may be replaced by a configuration of applying the superimposed bias to the nip formation roller 36 and grounding the secondary transfer inner surface roller 33. In this case, the polarity of the DC voltage is changed. Specifically, if the superimposed bias is applied to the secondary transfer inner surface roller 33 while using toner of negative polarity and grounding the nip formation roller 36, as illustrated in FIG. 3, a DC voltage of the same negative polarity as the polarity of the toner is used to set the time-averaged potential of the superimposed bias to the same negative polarity as the polarity of the toner. Meanwhile, if the secondary transfer inner surface roller 33 is grounded and the nip formation roller 36 is supplied with the superimposed bias, a DC voltage of positive polarity opposite the polarity of the toner is used to set the time-averaged potential of the superimposed bias to positive polarity opposite the polarity of the toner. The configuration of applying the superimposed bias to the secondary transfer inner surface roller 33 or the nip formation roller 36 may be replaced by a configuration of applying a DC voltage to one of the secondary transfer inner surface roller 33 and the nip formation roller 36 and applying an AC voltage to the other roller. The AC voltage employed in the present embodiment has a sinusoidal waveform. Alternatively, the AC voltage may have a rectangular waveform. Further, if the recording sheet P is not a sheet with relatively large surface roughness, such as a rough paper sheet, but a sheet with relatively small surface roughness, such as a plain paper sheet, an uneven density pattern following the pattern of irregularities is not formed. In this case, therefore, a bias including only a DC voltage may be applied as the transfer bias. If a sheet with relatively large surface roughness, such as a rough paper sheet, is used, however, the transfer bias including only a DC voltage needs to be switched to a superimposed bias.

The intermediate transfer belt 31 having passed the secondary transfer nip has post-transfer residual toner adhering thereto, having failed to be transferred to the recording sheet P. The residual toner is cleaned off the surface of the intermediate transfer belt 31 by the belt cleaner 37 which comes into contact with the outer circumferential surface of the intermediate transfer belt 31. The cleaning backup roller 34 disposed inside the loop of the intermediate transfer belt 31 backs up, from inside the loop, the cleaning of the intermediate transfer belt 31 by the belt cleaner 37.

The potential sensor 38, serving as an electric potential detector, is disposed outside the loop of the intermediate transfer belt 31. In the entire area of the intermediate transfer belt 31 in a circumferential direction thereof, a portion of the intermediate transfer belt 31 passing over the grounded drive roller 32 is disposed opposite the potential sensor 38 via a gap of approximately 4 mm. When the toner image primarily transferred onto the intermediate transfer belt 31 enters the position disposed opposite the potential sensor 38, the potential sensor 38 measures the surface potential of the toner image. In the present embodiment, a surface potential sensor EFS-22D manufactured by TDK Corporation is used as the potential sensor 38.

The fixing device 90 (e.g., a fuser unit) is provided on the right side of the secondary transfer nip in FIG. 3. In the fixing device 90, a fixing nip is formed by a fixing roller 91 including a heat generation source, such as a halogen lamp, and a pressure roller 92 which rotates while in contact with the fixing roller 91 with predetermined pressure. The recording sheet P sent into the fixing device 90 is nipped in the fixing nip such that a surface of the recording sheet P carrying an unfixed toner image is brought into close contact with the fixing roller 91. Then, with heat and pressure applied to the recording sheet P, the toner in the toner image is softened, and the full-color image is fixed on the recording sheet P. The recording sheet P discharged from the fixing device 90 passes a post-fixation conveying path, and is discharged outside the printer 301.

In the printer 301, the process linear velocity, i.e., the linear velocity of the photoconductors 2Y, 2M, 2C, and 2K or the intermediate transfer belt 31, in a normal mode is approximately 280 mm/s (millimeters per second). In a high image quality mode in which priority is given to the high image quality over the print speed, however, the process linear velocity is set to a lower value than in the normal mode. Further, in a high speed mode in which priority is given to the print speed over the image quality, the process linear velocity is set to a higher value than in the normal mode. Switching among the normal mode, the high image quality mode, and the high speed mode is performed through a key operation by a user on the control panel 50, serving as a user interface, or a printer property menu of a personal computer.

To form a monochrome image, a support plate supporting the primary transfer rollers 35Y, 35M, and 35C for the Y, M, and C colors in the transfer unit 30 is moved to separate the primary transfer rollers 35Y, 35M, and 35C away from the photoconductors 2Y, 2M, and 2C, respectively. Thereby, the outer circumferential surface of the intermediate transfer belt 31 is separated from the photoconductors 2Y, 2M, and 2C, and the intermediate transfer belt 31 is brought into contact only with the photoconductor 2K for the K color. In this state, only the image forming unit 1K for the K color is driven among the four image forming units 1Y, 1M, 1C, and 1K. Thereby, the K toner image is formed on the photoconductor 2K.

Figure 2:
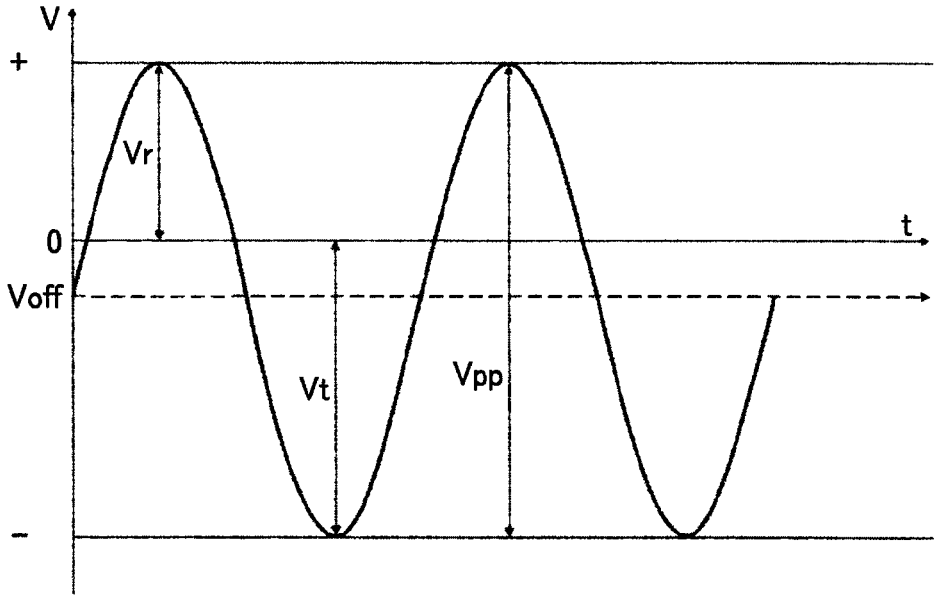
FIG. 2 RELATED ART
FIG. 2 is a waveform chart illustrating an example of a waveform of a transfer bias applied in the image forming apparatus shown in FIG. 1.

The secondary transfer bias power supply 39 outputs the secondary transfer bias including the superimposed bias illustrated in FIG. 2 described above. In the printer 301, the value of the DC component of the secondary transfer bias is substantially equal to the value of an offset voltage Voff. In the printer 301, in which the secondary transfer inner surface roller 33 is supplied with the secondary transfer bias and the nip formation roller 36 is grounded, if the secondary transfer bias has the same negative polarity as the polarity of the toner, the toner of negative polarity is electrostatically pushed from the side of the secondary transfer inner surface roller 33 toward the side of the nip formation roller 36 in the secondary transfer nip. Thereby, the toner on the intermediate transfer belt 31 is transferred onto the recording sheet P. Meanwhile, if the secondary transfer bias has positive polarity opposite the polarity of the toner, the toner of negative polarity is electrostatically attracted from the side of the nip formation roller 36 toward the side of the secondary transfer inner surface roller 33 in the secondary transfer nip. Thereby, the toner transferred to the recording sheet P is again attracted toward the intermediate transfer belt 31.

Subsequently, description is given of an observation experiment conducted by the present inventors.

Figure 5:
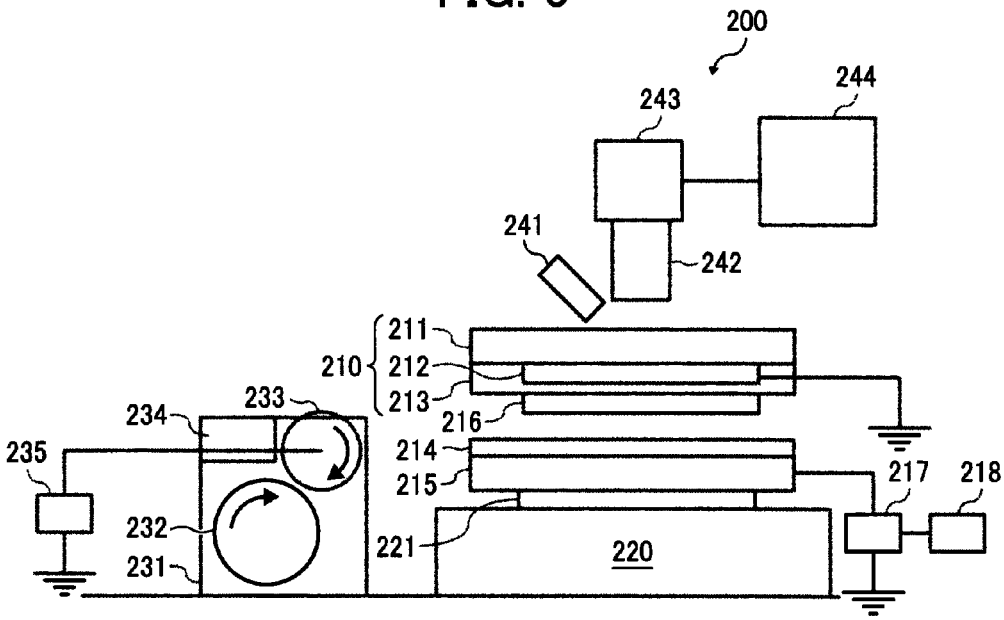
FIG. 5 is a schematic configuration diagram illustrating observation experiment equipment used in experiments.

To observe the behavior of toner in the secondary transfer nip, the present inventors produced special observation experiment equipment 200 shown in FIG. 5. FIG. 5 is a schematic configuration diagram illustrating the observation experiment equipment 200. The observation experiment equipment 200 includes a transparent substrate 210, a metal plate 215, a substrate 221, a development device 231, a power supply 235, a Z stage 220, a light source 241, a microscope 242, a high-speed camera 243, a personal computer 244, a voltage amplifier 217, a waveform generator 218, and so forth. The transparent substrate 210 includes a glass plate 211, a transparent electrode 212 made of ITO (Indium Tin Oxide) and disposed on a lower surface of the glass plate 211, and a transparent insulating layer 213 made of a transparent material covering the transparent electrode 212. The transparent substrate 210 is supported at a predetermined height position by a substrate support. The substrate support is allowed to move in the vertical and horizontal directions in the drawing by a moving assembly. In the illustrated example, the transparent substrate 210 is located above the Z stage 220 having the metal plate 215 placed thereon. The transparent substrate 210 is capable of moving to a position directly above the development device 231 disposed lateral to the Z stage 220, in accordance with the movement of the substrate support. The transparent electrode 212 of the transparent substrate 210 is connected to a grounded electrode fixed to the substrate support.

The development device 231 is similar in configuration to the development device 8K depicted in FIG. 4 of the printer 301 according to the first embodiment, and includes a screw 232, a development roll 233, a doctor blade 234, and so forth. The development roll 233 is driven to rotate with a development bias applied thereto by the power supply 235.

In accordance with the movement of the substrate support, the transparent substrate 210 is moved at a predetermined speed to a position directly above the development device 231 and disposed opposite the development roll 233 via a predetermined gap. Then, toner on the development roll 233 is transferred to the transparent electrode 212 of the transparent substrate 210. Thereby, a toner layer 216 having a predetermined thickness is formed on the transparent electrode 212 of the transparent substrate 210. The toner adhesion amount per unit area in the toner layer 216 is adjustable by the toner concentration in the developer, the toner charge amount, the development bias value, the gap between the transparent substrate 210 and the development roll 233, the moving speed of the transparent substrate 210, the rotation speed of the development roll 233, and so forth.

The transparent substrate 210 formed with the toner layer 216 is translated to a position disposed opposite a recording sheet 214 bonded to the planar metal plate 215 by a conductive adhesive. The metal plate 215 is placed on the substrate 221, which is provided with a load sensor and placed on the Z stage 220. Further, the metal plate 215 is connected to the voltage amplifier 217. The waveform generator 218 inputs to the voltage amplifier 217 a transfer bias including a DC voltage and an AC voltage. The transfer bias is amplified by the voltage amplifier 217 and applied to the metal plate 215. If the Z stage 220 is drive-controlled and elevates the metal plate 215, the recording sheet 214 starts coming into contact with the toner layer 216. If the metal plate 215 is further elevated, pressure applied to the toner layer 216 is increased. The elevation of the metal plate 215 is stopped when the output from the load sensor reaches a predetermined value. With the pressure maintained at the predetermined value, a transfer bias is applied to the metal plate 215, and the behavior of the toner is observed. After the observation, the Z stage 220 is drive-controlled to lower the metal plate 215 and separate the recording sheet 214 from the transparent substrate 210. Thereby, the toner layer 216 is transferred onto the recording sheet 214.

The observation of the behavior of the toner is carried out with the microscope 242 and the high-speed camera 243 disposed above the transparent substrate 210. The transparent substrate 210 is constructed of the layers of the glass plate 211, the transparent electrode 212, and the transparent insulating layer 213, which are all made of transparent material. It is therefore possible to observe, from above and through the transparent substrate 210, the behavior of the toner located under the transparent substrate 210.

In the present experiment, a microscope using a zoom lens VH-Z75 manufactured by Keyence Corporation was used as the microscope 242. Further, a camera FASTCAM-MAX 120KC manufactured by Photron Limited was used as the high-speed camera 243 drive-controlled by the personal computer 244. The microscope 242 and the high-speed camera 243 are supported by a camera support configured to adjust the focus of the microscope 242.

The behavior of the toner on the transparent substrate 210 was photographed as follows. That is, illumination light was applied by the light source 241 to the position for observing the behavior of the toner, and the focus of the microscope 242 was adjusted. Then, a transfer bias was applied to the metal plate 215 to cause the toner in the toner layer 216 adhering to a lower surface of the transparent substrate 210 to move toward the recording sheet 214. The behavior of the toner in this process was photographed by the high-speed camera 243.

The observation experiment equipment 200 illustrated in FIG. 5 and the printer 301 according to the first embodiment are different in the structure of the transfer nip in which toner is transferred onto a recording sheet. Therefore, the transfer electric field acting on the toner is different therebetween, even if the applied transfer bias is the same. To find appropriate observation conditions, transfer bias conditions allowing the observation experiment equipment 200 to attain favorable density reproducibility on recesses in a surface of a recording sheet were investigated. As the recording sheet 214, a sheet of FC Japanese paper SAZANAMI manufactured by NBS Ricoh Company, Ltd. was used. As the toner, Y toner having an average toner particle diameter of approximately 6.8 μm mixed with a relatively small amount of K toner was used. The observation experiment equipment 200 is configured to apply the transfer bias to a back side surface of the recording sheet 214 (i.e., SAZANAMI). In the observation experiment equipment 200, therefore, the polarity of the transfer bias capable of transferring the toner onto the recording sheet 214 is opposite the polarity of the transfer bias employed in the printer 301 according to the first embodiment (i.e., positive polarity). As the AC component of the transfer bias including a superimposed bias, an AC component having a sinusoidal waveform was employed. A frequency f of the AC component was set to approximately 1,000 Hz. Further, the DC component, which corresponds to the offset voltage Voff in the present example, was set to approximately 200 V, and a peak-to-peak voltage Vpp was set to approximately 1,000 V. The toner layer 216 was transferred onto the recording sheet 214 with a toner adhesion amount in a range of from approximately 0.4 mg/cm$^2$ to approximately 0.5 mg/cm$^2$. As a result, a sufficient image density was successfully obtained on the recesses in a surface of the SAZANAMI paper sheet.

Figure 6:
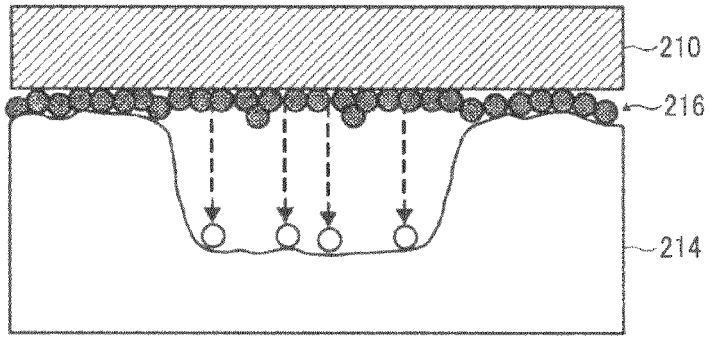
FIG. 6 is an enlarged schematic view illustrating the behavior of toner in a secondary transfer nip of the observation experiment equipment shown in FIG. 5 at an initial transfer stage.
Figure 7:
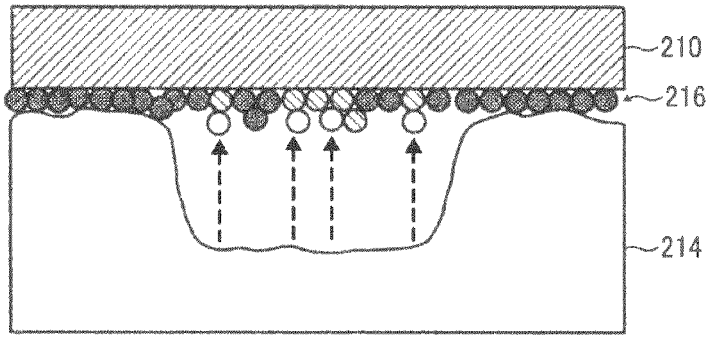
FIG. 7 is an enlarged schematic view illustrating the behavior of toner in the secondary transfer nip of the observation experiment equipment shown in FIG. 5 at an intermediate transfer stage.
Figure 8:
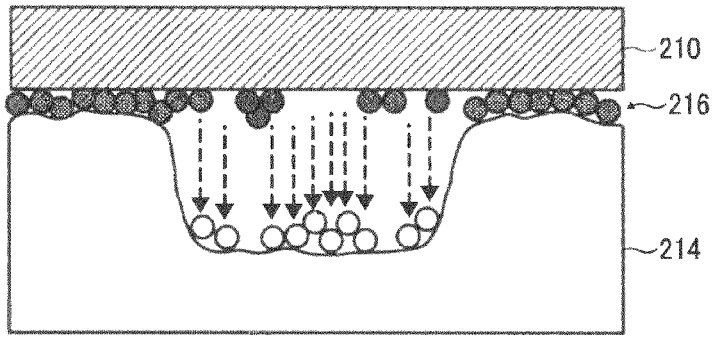
FIG. 8 is an enlarged schematic view illustrating the behavior of toner in the secondary transfer nip of the observation experiment equipment shown in FIG. 5 at a final transfer stage.

Under the above-described conditions, the behavior of the toner was photographed with the microscope 242 focused on the toner layer 216 on the transparent substrate 210, and the following phenomenon was observed. That is, the toner particles in the toner layer 216 moved back and forth between the transparent substrate 210 and the recording sheet 214 owing to an alternating electric field generated by the AC component of the transfer bias. In accordance with an increase in the number of the back-and-forth movements, the amount of toner particles moving back and forth was increased. Specifically, in the transfer nip, there was an action of the alternating electric field and a back-and-forth movement of toner particles in every cycle 1/f of the AC component of the transfer bias. In the first cycle, only toner particles present on a surface of the toner layer 216 separated from the toner layer 216, as illustrated in FIG. 6. The toner particles then entered the recesses in the recording sheet 214, and thereafter returned to the toner layer 216, as illustrated in FIG. 7. In this process, the returning toner particles collided with other toner particles remaining in the toner layer 216, and thereby reduced the adhesion of the other toner particles to the toner layer 216 or the transparent substrate 210. In the next cycle, therefore, a larger amount of toner particles than in the last cycle separated from the toner layer 216, as illustrated in FIG. 8. Then, the toner particles entered the recesses in the recording sheet 214, and thereafter returned to the toner layer 216. In this process, the returning toner particles collided with other toner particles still remaining in the toner layer 216, and thereby reduced the adhesion of the other toner particles to the toner layer 216 or the transparent substrate 210. In the next cycle, therefore, a still larger amount of toner particles than in the last cycle separated from the toner layer 216. In the above-described manner, the number of toner particles moving back and forth was gradually increased in every back-and-forth movement. After the lapse of a nip passage time, i.e., a time corresponding to the actual nip passage time in the observation experiment equipment 200, a sufficient amount of toner had been transferred to the recesses in the recording sheet 214. The phenomenon described above was revealed from the experiment.

Further, the behavior of the toner was photographed under conditions of a DC voltage (i.e., corresponding to the offset voltage Voff in the present example) of approximately 200 V and the peak-to-peak voltage Vpp of approximately 800 V, and the following phenomenon was observed. That is, some of the toner particles in the toner layer 216 present on the surface thereof separated from the toner layer 216 in the first cycle, and entered the recesses in the recording sheet 214. Thereafter, however, the toner particles in the recesses remained therein, without returning to the toner layer 216. In the next cycle, a very small number of toner particles newly separated from the toner layer 216 and entered the recesses in the recording sheet 214. After the lapse of the nip passage time, therefore, only a relatively small amount of toner particles had been transferred to the recesses in the recording sheet 214. The present inventors conducted further experiments, and found the following. That is, a returning peak value Vr capable of causing the toner particles having separated from the toner layer 216 and entered the recesses in the recording sheet 214 to return to the toner layer 216 in the first cycle is affected by the toner adhesion amount per unit area on the transparent substrate 210. Specifically, the larger is the toner adhesion amount on the transparent substrate 210, the larger is the returning peak value Vr capable of causing the toner particles in the recesses in the recording sheet 214 to return to the toner layer 216.

Subsequently, characteristic configurations of the printer 301 will be described.

Figure 9:
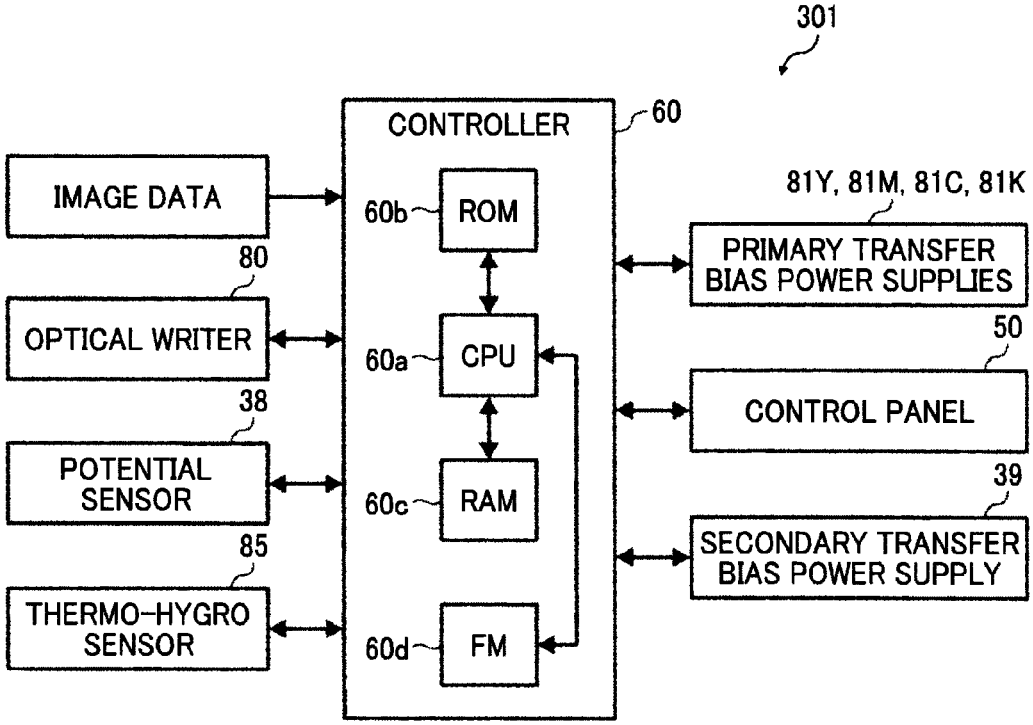
FIG. 9 is a block diagram illustrating a controller and components connected thereto of the printer shown in FIG. 3.

FIG. 9 is a block diagram illustrating a part of an electrical circuit of the printer 301. In the drawing, the controller 60 constituting a part of the transfer bias generator includes a CPU (Central Processing Unit) 60*a* serving as an operation device, the RAM (Random Access Memory) 60*c* serving as a non-volatile memory, a ROM (Read-Only Memory) 60*b* serving as a temporary storage device, and a flash memory (FM) 60*d*. The controller 60 controlling the entire printer 301 is connected to a variety of devices and sensors. The drawing, however, illustrates only devices and sensors related to the characteristic configurations of the printer 301.

The potential sensor 38 is capable of measuring a toner image potential Vtoner of the superimposed toner image transferred onto the intermediate transfer belt 31. The controller 60 stores, in the flash memory 60*d*, the result of measurement of the toner image potential Vtoner by the potential sensor 38.

A thermo-hygro sensor 85 serving as an environment detector detects the temperature and humidity inside a housing of the printer 301, and outputs the result of detection to the controller 60. On the basis of temperature detection data and humidity detection data, the controller 60 performs a variety of processes, which will be described later.

The primary transfer bias power supplies 81Y, 81M, 81C, and 81K output the primary transfer bias to be applied to the primary transfer rollers 35Y, 35M, 35C, and 35K. The secondary transfer bias power supply 39 outputs the secondary transfer bias to be applied to the secondary transfer inner surface roller 33, and constitutes the transfer bias generator together with the controller 60. The control panel 50 includes a touch panel and a plurality of key buttons. The control panel 50 displays an image on a screen of the touch panel, and receives an instruction input by the user on the touch panel or the key buttons. The control panel 50 is capable of displaying an image on the touch panel on the basis of a control signal transmitted from the controller 60.

On the basis of a control program stored in the RAM 60*c* or the ROM 60*b*, the controller 60 controls the driving of a variety of devices, and performs a variety of data processing. As examples of the data processing, the controller 60 calculates the image area ratio of each color toner image on the basis of image data transmitted from, for example, an external personal computer, and calculates the image area ratio of a region of the intermediate transfer belt 31 immediately before, that is, immediately upstream from, the secondary transfer nip in the belt moving direction R1. Further, on the basis of the calculated image area ratio, the controller 60 calculates the respective target values of the outputs from the primary transfer bias power supplies 81Y, 81M, 81C, and 81K, and outputs the calculated target values to the primary transfer bias power supplies 81Y, 81M, 81C, and 81K. Further, on the basis of the image area ratio, the controller 60 calculates the target value of the output from the secondary transfer bias power supply 39, and outputs the calculated target value to the secondary transfer bias power supply 39. The above-described target output values are output as PWM (Pulse Width Modulation) signals. Further, the controller 60 calculates the image area ratio on the basis of a laser writing signal of the optical writer 80.

Figure 10:
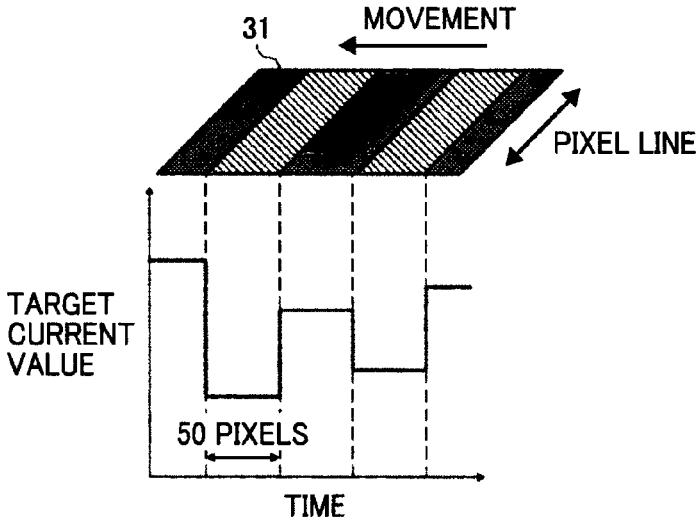
FIG. 10 is a schematic diagram for explaining a 50-line block of an intermediate transfer belt of the printer shown in FIG. 3.

The secondary transfer bias power supply 39 outputs the secondary transfer bias under constant current control. Specifically, the secondary transfer bias power supply 39 outputs a current having a value substantially equal to the target current value output from the controller 60. The controller 60 functions as an adhesion amount recognition device that recognizes the amount of toner adhering to a region included in the area of the intermediate transfer belt 31 in the circumferential direction and entering the secondary transfer nip (hereinafter referred to as the nip entrance region). Specifically, the image area ratio of the superimposed toner image in the nip entrance region is correlated with the amount of toner per unit area adhering to the nip entrance region. Calculating the image area ratio of the superimposed toner image in the nip entrance region, therefore, the controller 60 recognizes the amount of toner per unit area adhering to the nip entrance region. Further, in accordance with the image area ratio, the controller 60 changes the target value of the current output from the secondary transfer bias power supply 39. Specifically, as illustrated in FIG. 10, the surface of the intermediate transfer belt 31 is theoretically divided into blocks of fifty pixels in a sub scanning direction, i.e., a moving direction of the surface of the photoconductors 2Y, 2M, 2C, and 2K or the intermediate transfer belt 31, with reference to a leading edge of each page. Each of the divided blocks (hereinafter referred to as the 50-line block) includes fifty pixel lines each formed by a collection of pixels aligned in a straight line in the main scanning direction. For each of the pixel lines, the proportion of the number of pixels corresponding to the image area (i.e., the superimposed toner image) to the total number of pixels is calculated as the image area ratio. Further, the mean value of the image area ratios of the fifty pixel lines is calculated as the image area ratio of the 50-line block. The target current value of the secondary transfer bias power supply 39 is set in accordance with the image area ratio of one of the plurality of 50-line blocks currently passing the secondary transfer nip.

For example, the entire area of the intermediate transfer belt 31 is divided into the 50-line blocks each having a size of fifty pixels in the belt moving direction R1. At the time at which a leading edge of one of the 50-line blocks located immediately before the secondary transfer nip reaches the position separated from an entrance of the secondary transfer nip by a predetermined distance (hereinafter referred to as the calculation reference time), the controller 60 calculates the image area ratio of the 50-line block. Specifically, the controller 60 calculates the image area ratio of the Y color in the 50-line block on the basis of the number of dots written on the photoconductor 2Y for the Y color by the optical writer 80 during the period from a time point preceding the above-described calculation reference time by a first predetermined time to a time point preceding the calculation reference time by a second predetermined time. Further, the controller 60 calculates the image area ratio of the M color in the 50-line block on the basis of the number of dots written on the photoconductor 2M for the M color by the optical writer 80 during the period from a time point preceding the calculation reference time by a third predetermined time to a time point preceding the calculation reference time by a fourth predetermined time. Further, the controller 60 calculates the image area ratio of the C color in the 50-line block on the basis of the number of dots written on the photoconductor 2C for the C color by the optical writer 80 during the period from a time point preceding the calculation reference time by a fifth predetermined time to a time point preceding the calculation reference time by a sixth predetermined time. Further, the controller 60 calculates the image area ratio of the K color in the 50-line block on the basis of the number of dots written on the photoconductor 2K for the K color by the optical writer 80 during the period from a time point preceding the calculation reference time by a seventh predetermined time to a time point preceding the calculation reference time by an eighth predetermined time. Then, the controller 60 determines the sum of the four image area ratios of the Y, M, C, and K colors as the image area ratio of the 50-line block. The 50-line block having the thus calculated image area ratio is adjacent to the next 50-line block, which is located downstream from the first 50-line block in the belt moving direction R1. The image area ratio of the next 50-line block starts being calculated at the time at which a leading edge of the next 50-line block reaches the position separated from the entrance of the secondary transfer nip by the predetermined distance, i.e., the calculation reference time of the next 50-line block.

Figure 11:
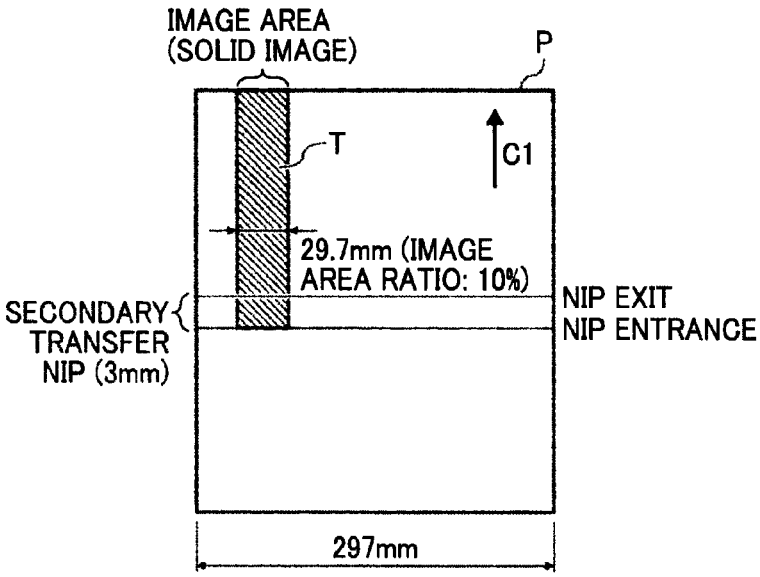
FIG. 11 is a schematic diagram illustrating an A3-size recording sheet and a first example of a toner image formed thereon.

FIG. 11 is a schematic diagram illustrating an A3-size recording sheet P and a first example of a toner image T formed thereon. In the secondary transfer nip, the recording sheet P is conveyed in a conveyance direction C1 indicated by the arrow in the drawing. In the printer 301 according to the first embodiment, the size of the intermediate transfer belt 31 in a width direction, that is, an axial direction thereof, is slightly greater than the size of the A3-size recording sheet P in the shorter direction, which is approximately 297 mm. The secondary transfer nip is a region in which the intermediate transfer belt 31 and the nip formation roller 36 come into contact with each other. The width of a roller portion of the nip formation roller 36 is greater than the width of the intermediate transfer belt 31. Therefore, the width of the secondary transfer nip in the width direction of the intermediate transfer belt 31 is substantially equal to the width of the intermediate transfer belt 31, which is slightly greater than the size of the A3-size recording sheet P in the shorter direction, as described above. However, the controller 60 of the printer 301 according to the first embodiment is configured to calculate the image area ratio of the 50-line block of the intermediate transfer belt 31 by assuming, for convenience, that the width of the secondary transfer nip in the width direction of the intermediate transfer belt 31 is substantially equal to the size of the A3-size recording sheet P in the shorter direction. The length of the secondary transfer nip in the belt moving direction R1 is approximately 3 mm.

The recording sheet P in the drawing is formed with a strip-shaped toner image T extending in the conveyance direction C1 of the recording sheet P. The length of the toner image T in the conveyance direction C1 is approximately 220 mm. The toner image T extends over a region substantially half the size of the recording sheet P in a longitudinal direction thereof, as illustrated in the drawing. The toner image T is a solid image including only one of the four color toners, i.e., the Y, M, C, and K toners. The width of the toner image T in the shorter direction, that is, the direction perpendicular to the conveyance direction C1, is approximately 29.7 mm, i.e., approximately one tenth of the width of the secondary transfer nip in the width direction of the intermediate transfer belt 31, which is assumed to be approximately 297 mm for convenience. Therefore, the image area ratio of the 50-line block is approximately 10 percent in the region where the toner image T extends in the conveyance direction C1 of the recording sheet P. When a region included in the area of the intermediate transfer belt 31 in the circumferential direction and carrying the illustrated toner image enters the secondary transfer nip, the controller 60 calculates the image area ratio of the 50-line block as approximately 10 percent, and the target value of the current output from the secondary transfer bias power supply 39 is set in accordance with the image area ratio of approximately 10 percent.

Figure 12:
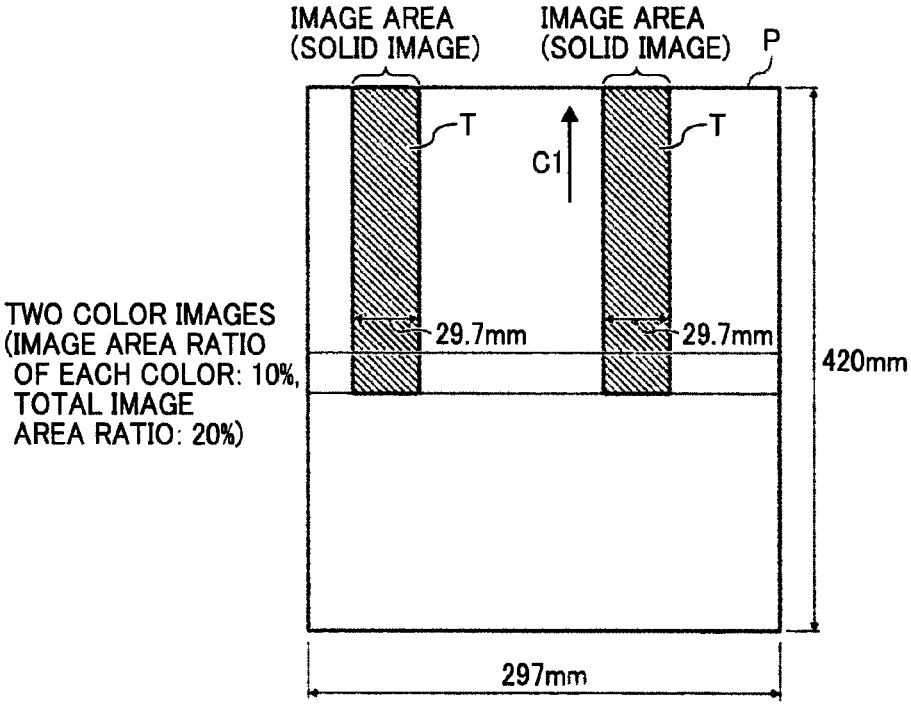
FIG. 12 is a schematic diagram illustrating an A3-size recording sheet and a second example of a toner image formed thereon.

FIG. 12 is a schematic diagram illustrating an A3-size recording sheet P and a second example of toner images T formed thereon. The recording sheet P in the drawing is formed with two strip-shaped toner images T extending in the conveyance direction C1 of the recording sheet P such that the toner images T are isolated from each other by a predetermined distance in a direction perpendicular to the conveyance direction C1. The length of each of the toner images T in the conveyance direction C1 is approximately 220 mm. The two toner images T extend in the same region in a longitudinal direction of the recording sheet P, as illustrated in the drawing. The two toner images T are solid images each including only one color toner different in color from the toner of the other toner image T. Further, the width of each of the toner images T in the shorter direction is approximately 29.7 mm. Therefore, the image area ratio of the 50-line block is approximately 20 percent in the region in which the toner images T extend in the conveyance direction C1. When a region included in the area of the intermediate transfer belt 31 in the circumferential direction thereof and carrying the illustrated toner images T enters the secondary transfer nip, the controller 60 calculates the image area ratio of the 50-line block as approximately 20 percent, and the target value of the current output from the secondary transfer bias power supply 39 is set in accordance with the image area ratio of approximately 20 percent.

In the printer 301, the image area ratio of the 50-line block is calculated as the sum of the image area ratios calculated separately for the Y, M, C, and K colors. For example, therefore, if the two toner images T illustrated in the drawing are not isolated from each other, unlike the illustrated toner images T, but are completely superimposed upon each other to form a two-color superimposed toner image, the image area ratio of the 50-line block corresponding to the two-color superimposed toner image is not approximately 10 percent but approximately 20 percent.

Figure 13:
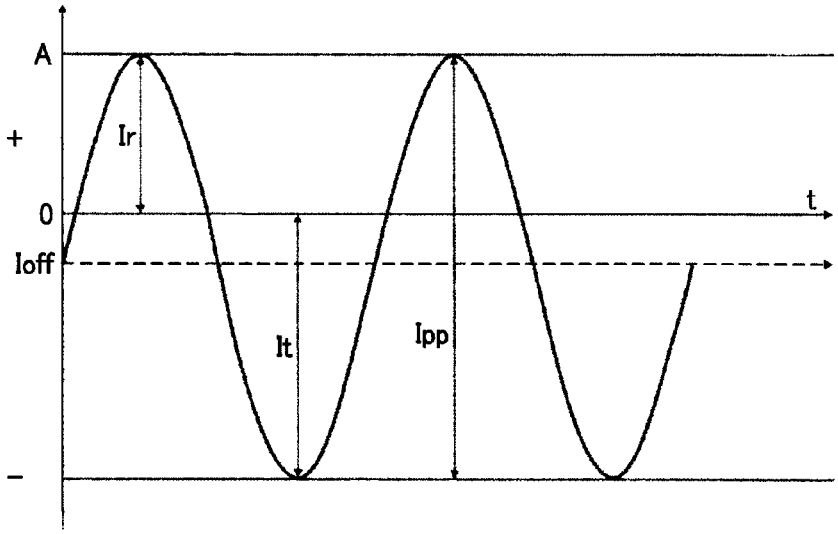
FIG. 13 is a waveform chart illustrating a current waveform of a secondary transfer bias output from a secondary transfer bias power supply of the printer shown in FIG. 3.

FIG. 13 is a waveform chart illustrating a current waveform of the secondary transfer bias output from the secondary transfer bias power supply 39. In the drawing, an offset current Ioff in amperes (A) represents the time-averaged value of the current of the secondary transfer bias. As illustrated in the drawing, the current waveform of the secondary transfer bias including a superimposed bias is a sinusoidal waveform, and includes a positive peak value and a negative peak value. A reference sign Ipp represents a peak-to-peak current, the value of which is substantially equal to the peak-to-peak value of the AC component. A reference sign It represents one of the two peak values for moving the toner in the secondary transfer nip from the side of the secondary transfer inner surface roller 33 (i.e., the belt side) toward the side of the nip formation roller 36 (i.e., the recording sheet side). A peak value It is the negative peak value in the present example (hereinafter referred to as the transferring peak value It). Further, a reference sign Ir represents the other peak value for causing the toner transferred to the recording sheet P to return from the recording sheet side toward the belt side. A peak value Ir is the positive peak value in the present example (hereinafter referred to as the returning peak value Ir).

In the printer 301, in which the secondary transfer inner surface roller 33 comes into contact with an inner circumferential surface of the intermediate transfer belt 31 and the nip formation roller 36 comes into contact with the outer circumferential surface of the intermediate transfer belt 31 to form the secondary transfer nip, the secondary transfer inner surface roller 33 is supplied with the secondary transfer bias, and the nip formation roller 36 is grounded, as described above. In this configuration, the offset current Ioff illustrated in FIG. 13 has negative polarity, as illustrated in the drawing. This indicates that the average potential of the secondary transfer inner surface roller 33 has negative polarity. With the average potential of the secondary transfer inner surface roller 33 thus having negative polarity, toner of negative polarity relatively moves, in the secondary transfer nip, from the side of the secondary transfer inner surface roller 33 toward the side of the nip formation roller 36, and the toner on the intermediate transfer belt 31 is transferred onto the recording sheet P. In the first embodiment, the value of the offset current Ioff is substantially equal to the current value of the DC component output from the secondary transfer bias power supply 39.

The printer 301 according to the first embodiment uses, as the secondary transfer bias power supply 39, a power supply which outputs the DC component and the AC component under constant current control. In the DC component and the AC component, therefore, the current output having the waveform illustrated in FIG. 13 is obtained. Meanwhile, if the printer 301 uses, as the secondary transfer bias power supply 39, a power supply which outputs the DC component and the AC component under constant voltage control, the voltage output having the waveform as illustrated in FIG. 2 is obtained in the DC component and the AC component.

Figure 14:
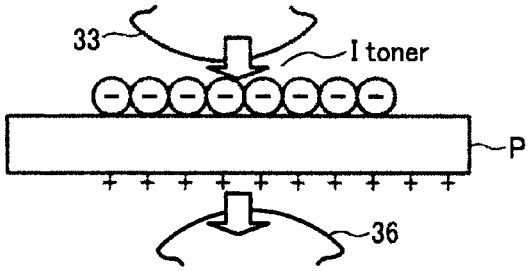
FIG. 14 is a schematic diagram for explaining a toner holding current, which corresponds to a current value required to hold toner on a surface of a recording sheet in the secondary transfer nip of the printer shown in FIG. 3.

FIG. 14 is a schematic diagram for explaining a toner holding current Itoner, which corresponds to the current value required to hold the toner on the surface of the recording sheet P in the secondary transfer nip. In the drawing, illustration of the intermediate transfer belt 31 is omitted for convenience. In the secondary transfer nip, the toner holding current Itoner for holding the toner on the surface of the recording sheet P alternates owing to the DC component. In the printer 301 according to the first embodiment, a part of the offset current Ioff acts as the toner holding current Itoner. An increase in the amount of the toner entering the secondary transfer nip results in an increase in the charge amount of the toner entering the secondary transfer nip. To hold the toner on the surface of the recording sheet P, therefore, it is necessary to increase the toner holding current Itoner. Accordingly, it is necessary to increase the offset current Ioff in accordance with the increase in the amount of the toner entering the secondary transfer nip.

It is assumed that the offset current Ioff has been set to a relatively large value such that a sufficient amount of the toner holding current Itoner can be supplied, even if a relatively large amount of toner enters the secondary transfer nip. In this case, if a relatively small amount of toner enters the secondary transfer nip, an excessive amount of current is supplied to the toner image in the secondary transfer nip. As a result, a phenomenon called toner scattering occurs in which toner is scattered around a toner image.

In view of the above, the controller 60 is configured to perform a process of changing the target value of the offset current Ioff, which corresponds to the DC component output from the secondary transfer bias power supply 39, in accordance with the image area ratio of the 50-line block correlated with the toner adhesion amount in the 50-line block. Accordingly, it is possible to supply an appropriate amount of the toner holding current Itoner to the toner image at an exit of the secondary transfer nip, irrespective of the image area ratio, and thus to minimize a transfer failure of the toner image and toner scattering.

Meanwhile, the appropriate value of the returning peak value Ir illustrated in FIG. 13 varies depending on the toner adhesion amount per unit area on the intermediate transfer belt 31 entering the secondary transfer nip. This is because the larger is the toner adhesion amount, the larger is the absolute value of the returning peak value Ir capable of returning the toner from the recesses in the surface of the recording sheet P to the intermediate transfer belt 31. It is assumed that the target current value of the AC component output from the secondary transfer bias power supply 39, i.e., the target value of the peak-to-peak current Ipp, is set to a constant value, irrespective of the toner adhesion amount. In this case, when a region of the intermediate transfer belt 31 with a relatively large toner adhesion amount enters the secondary transfer nip, the returning peak value Ir may be reduced to be smaller than the appropriate value, and may fail to return a sufficient amount of toner from the recesses in the surface of the recording sheet P to the intermediate transfer belt 31. As a result, a deficiency in image density may occur on the recesses in the surface of the recording sheet P. This is considered to be due to the following reason. That is, an increase in the amount of the toner entering the secondary transfer nip results in an increase in surface potential of the toner layer, which is represented as $\rho*d/(2*\in)$ where $\rho$ represents the volume charge density of the toner layer, d represents the thickness of the toner layer, and $\in$ represents the dielectric constant, provided that the toner layer is formed on a grounded metal, for example. As a result, the voltage and current required to cause the back-and-forth movement of the toner is also increased.

Meanwhile, if the value of the peak-to-peak current Ipp is set to a relatively large value to obtain a sufficient returning peak value Ir, irrespective of the toner adhesion amount, so as to prevent the deficiency in image density on the recesses in the surface of the recording sheet P, white spots tend to appear in a region of the intermediate transfer belt 31 with a relatively small toner adhesion amount, when the region enters the secondary transfer nip. For example, the potential difference between the secondary transfer inner surface roller 33 and the nip formation roller 36 is the largest when the secondary transfer bias reaches the transferring peak value It. In this state, discharge tends to occur from the side of the secondary transfer inner surface roller 33 toward the side of the nip formation roller 36 in the recesses in the surface of the recording sheet P nipped in the secondary transfer nip. In this case, if the toner amount in the secondary transfer nip is relatively large, toner particles opposite in polarity to the transferring peak value It are present between the secondary transfer inner surface roller 33 and the recording sheet P, and thus the above-described discharge is minimized. Meanwhile, if the toner amount is relatively small, the toner particles opposite in polarity to the transferring peak value Vt and present between the secondary transfer inner surface roller 33 and the recording sheet P are small in amount. Therefore, the above-described discharge occurs. As a result, the toner particles oppositely charged by the discharge are hardly transferred into the recesses in the surface of the recording sheet P, and a multitude of white spots appear in the image area on the recesses. In particular, in an image forming apparatus using, as the intermediate transfer belt 31, a belt made of polyimide in consideration of properties such as smoothness and elongation resistance, as in the printer 301, it is difficult to flexibly deform a surface of the belt to follow irregularities on a surface of a recording sheet in the secondary transfer nip. Therefore, gaps are easily formed between the surface of the belt and the recesses in the surface of the recording sheet. As a result, discharge and resultant appearance of white spots tend to occur. For example, if a region of the intermediate transfer belt 31 with a relatively large toner adhesion amount enters the secondary transfer nip, the returning peak value Ir may be reduced to be smaller than the appropriate value, and may fail to return a sufficient amount of toner from the recesses in the surface of the recording sheet P to the intermediate transfer belt 31. As a result, a deficiency in image density may occur on the recesses in the surface of the recording sheet P. Meanwhile, if the value of the peak-to-peak current Ipp is set to a relatively large value to obtain a sufficient returning peak value Ir, irrespective of the toner adhesion amount, so as to prevent the deficiency in image density, white spots tend to appear in a region of the intermediate transfer belt 31 with a relatively small toner adhesion amount, when the region enters the secondary transfer nip. The reason therefor is as described above.

Figure 15:
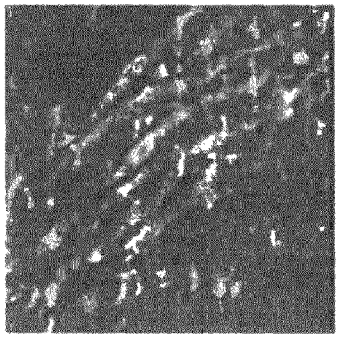
FIG. 15 is a photographic image illustrating an enlarged view of an image in which a multitude of white spots appear on recesses in a surface of a recording sheet owing to an inappropriately large transferring peak value relative to an amount of toner entering the secondary transfer nip of the printer shown in FIG. 3.

FIG. 15 is a photographic image illustrating an enlarged view of an image in which a multitude of white spots appear on recesses in a surface of a recording sheet owing to an inappropriately large transferring peak value It relative to the amount of toner entering the secondary transfer nip. With the appearance of the multitude of white spots on the recesses in the surface of the recording sheet, most parts of an image area located on the recesses in the surface of the recording sheet are omitted as blank portions.

Figure 16:
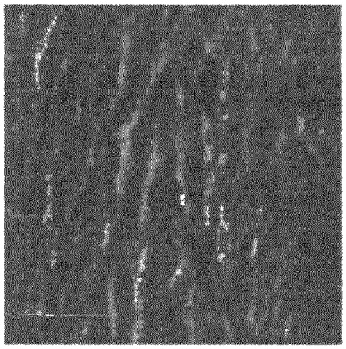
FIG. 16 is a photographic image illustrating an enlarged view of an image in which a deficiency in image density occurs in an image area on recesses in a surface of a recording sheet owing to an inappropriately small returning peak value relative to the amount of toner entering the secondary transfer nip of the printer shown in FIG. 3.

FIG. 16 is a photographic image illustrating an enlarged view of an image in which a deficiency in image density occurs in an image area on recesses in a surface of a recording sheet owing to an inappropriately small returning peak value Ir relative to the amount of toner entering the secondary transfer nip. It is observed that the density is lower in the image area located on the recesses in the surface of the recording sheet than in an image area located on projections on the surface of the recording sheet.

Figure 17:
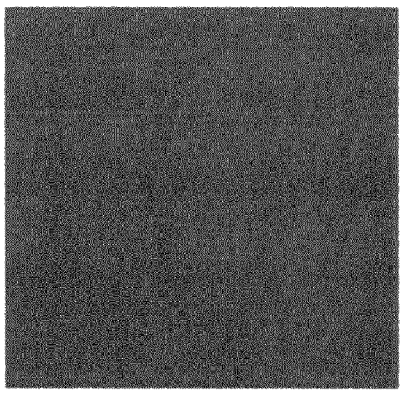
FIG. 17 is a photographic image illustrating an enlarged view of a favorable image in which the appearance of white spots and the deficiency in image density do not occur in an image area on recesses in a surface of a recording sheet owing to an appropriate transferring peak value and an appropriate returning peak value relative to the amount of toner entering the secondary transfer nip of the printer shown in FIG. 3.

FIG. 17 is a photographic image illustrating an enlarged view of a favorable image in which the appearance of white spots and the deficiency in image density do not occur in an image area corresponding to recesses in a surface of a recording sheet owing to an appropriate transferring peak value It and an appropriate returning peak value Ir relative to the amount of toner entering the secondary transfer nip. With the transferring peak value It and the returning peak value Ir set to respective appropriate values suitable for the toner amount, it is possible to obtain a favorable solid image as illustrated in the drawing, which is free from white spots and the deficiency in image density on the recesses in the surface of the recording sheet. Each of the images illustrated in FIGS. 15 to 17 was output to an approximately 2.5 cm square sheet of Japanese paper manufactured by Tokushu Paper Mfg. Co., Ltd. under the trade name Leathac 66 (260 kg type).

In view of the above results, the controller 60 is configured to perform a process of changing the target current value of the AC component output from the secondary transfer bias power supply 39, i.e., the target value of the peak-to-peak current Ipp, in accordance with the image area ratio of the 50-line block of the intermediate transfer belt 31 entering the secondary transfer nip. Accordingly, it is possible to supply the toner image with a current having an appropriate returning peak value Ir, irrespective of the image area ratio, and thus to reliably cause the toner in the toner image to move back and forth between the intermediate transfer belt 31 and the recesses in the surface of the recording sheet P. Further, it is possible to supply the toner image with a current having an appropriate transferring peak value It, and thus to minimize the appearance of white spots.

Figure 18A:
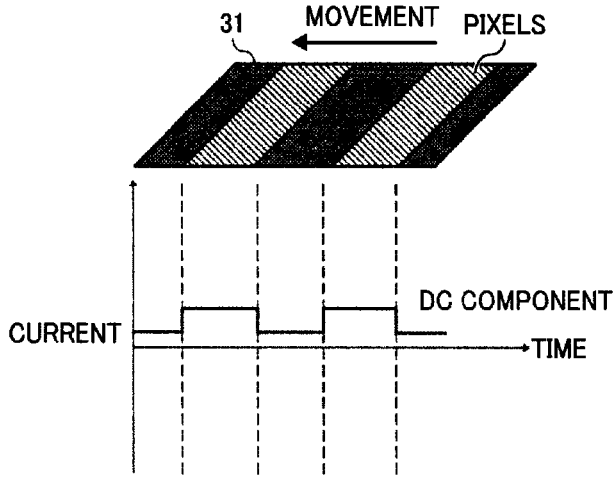
FIG. 18A is a first explanatory diagram for explaining the time for changing the target value of a peak-to-peak current and the time for changing the target value of an offset current.
Figure 18B:
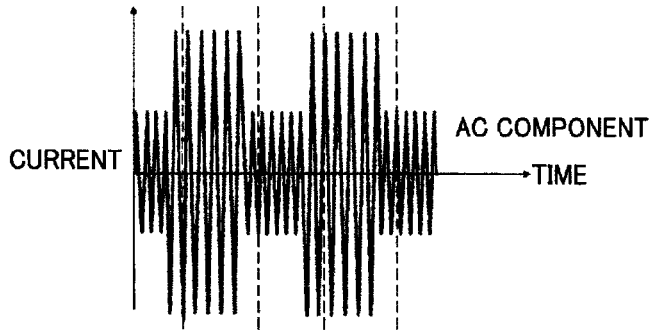
FIG. 18B is a second explanatory diagram for explaining the time for changing the target value of the peak-to-peak current and the time for changing the target value of the offset current.
Figure 18C:
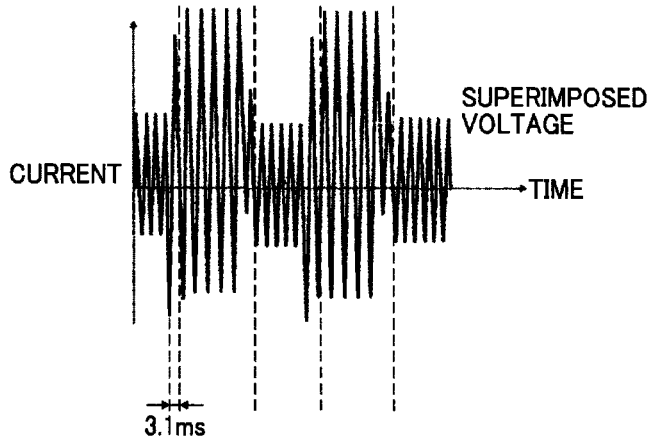
FIG. 18C is a third explanatory diagram for explaining the time for changing the target value of the peak-to-peak current and the time for changing the target value of the offset current.

FIGS. 18A to 18C are explanatory diagrams for explaining the time for changing the target current value of the AC component of the secondary transfer bias, i.e., the target value of the peak-to-peak current Ipp, and the time for changing the target current value of the DC component of the secondary transfer bias, i.e., the target value of the offset current Ioff. The controller 60 sets the time for changing the target value of the peak-to-peak current Ipp and the time for changing the target value of the offset current Ioff to be different from each other. For example, the target value of the peak-to-peak current Ipp is changed when a leading edge of the 50-line block of the intermediate transfer belt 31 enters the entrance of the secondary transfer nip. Meanwhile, the target value of the offset current Ioff is changed when the leading edge of the 50-line block of the intermediate transfer belt 31 enters the exit of the secondary transfer nip.

The printer 301 forms an image with a resolution of approximately 600 dpi (dots per inch). Therefore, the diameter of each pixel is approximately 42.3 μm, and the length of the 50-line block in the belt moving direction R1 is approximately 2.12 mm. As described above, the process linear velocity in the normal node is approximately 280 mm/s. In the normal mode, therefore, the respective target values of the peak-to-peak current Ipp and the offset current Ioff are changed at time intervals of approximately 7.6 ms (milliseconds). However, there is a time lag from each of the times for changing the target values. In the case of a given 50-line block of the intermediate transfer belt 31, when a trailing edge of the 50-line block enters the entrance of the secondary transfer nip, the target value of the peak-to-peak current Ipp is changed to the value according to the image area ratio of the 50-line block. A nip length d of the secondary transfer nip is set to a value larger than a length L of the 50-line block in the belt moving direction R1. At this stage, therefore, the target value of the offset current Ioff has not been changed yet. The moving distance from the entry of the trailing edge of the 50-line block into the entrance of the secondary transfer nip to the passage of the leading edge of the 50-line block through the exit of the secondary transfer nip is approximately 0.88 mm (i.e., 3-2.12). Further, the time taken for the movement is approximately 3.1 ms (i.e., 0.88/280*1,000). Accordingly, after the lapse of approximately 3.1 ms since the change in the target value of the peak-to-peak current Ipp, the target value of the offset current Ioff is changed to the value according to the image area ratio of the 50-line block described above.

As described above, the nip length d, i.e., the length of the secondary transfer nip in the belt moving direction R1, is set to be greater than the length L of the 50-line block, and the target value of the peak-to-peak current Ipp is changed to the value according to the image area ratio of the 50-line block of the intermediate transfer belt 31 when the trailing edge of the 50-line block enters the entrance of the secondary transfer nip. This configuration is based on the following reason. That is, it is normally desired to recognize, at as short time intervals as possible, the change in toner amount in the secondary transfer nip occurring in accordance with the movement of the intermediate transfer belt 31. The toner amount in the secondary transfer nip may be substantially changed by a slight movement of the intermediate transfer belt 31 by the length of one pixel. Ideally, therefore, it is desired to newly recognize the toner amount in the secondary transfer nip every time the intermediate transfer belt 31 moves by the length of one pixel. To achieve such an operation, however, the controller 60 needs to have a substantially high CPU speed. Such a controller is unrealistic as the controller 60 used in a commonly used image forming apparatus. In view of the processing speed of the controller 60 mounted in a commonly used image forming apparatus, therefore, the printer 301 is configured to recognize the change in toner amount in the secondary transfer nip every time the intermediate transfer belt 31 moves by the length of the 50-line block.

If a 50-line block as the target for calculation of the image area ratio is present in the secondary transfer nip, it is ideal to continue applying the peak-to-peak current Ipp according to the 50-line block. However, the length L of the 50-line block is approximately 2.12 mm, and the nip length d is approximately 3 mm. In some cases, therefore, the trailing edge of the preceding 50-line block and the leading edge of the subsequent 50-line block are present in the secondary transfer nip at the same time. An issue in such cases is which one of the 50-line blocks should be used as the basis for calculating the target value. As described above, the peak-to-peak current Ipp corresponding to the AC component of the secondary transfer bias is intended to cause the toner to perform a plurality of back-and-forth movements between the intermediate transfer belt 31 and the recording sheet P in the secondary transfer nip. In every cycle of back-and-forth movement of the toner in the secondary transfer nip, the amount of toner transferred into the recesses in the surface of the recording sheet P is increased, as described above. In consideration of this behavior of the toner, to obtain a sufficient effect of the AC component, it is necessary to apply an effective AC component, i.e., the peak-to-peak current Ipp, to all toners in the 50-line block in the secondary transfer nip to cause at least two cycles of back-and-forth movement. It is assumed that the time of entering the leading edge of the 50-line block into the entrance of the secondary transfer nip is used as the time for changing the target value of the peak-to-peak current Ipp. In this case, the alternating electric field may act only once on the trailing edge of the 50-line block, and the above-described effect may fail to be obtained. Meanwhile, if the time of entering the trailing edge of the 50-line block into the entrance of the secondary transfer nip is used as the time for changing the target value of the peak-to-peak current Ipp, the leading edge of the 50-line block is still present in the secondary transfer nip at the time. If the toner in the leading edge of the 50-line block is caused to perform at least two cycles of back-and-forth movement before reaching the exit of the secondary transfer nip, at least two cycles of back-and-forth movement of the toner are performed not only in the leading edge but also in the entire area from the leading edge to the tailing edge of the 50-line block. In the printer 301, therefore, the nip length d is set to be greater than the length L of the 50-line block, and the target value of the peak-to-peak current Ipp is changed to the value according to the image area ratio of the 50-line block of the intermediate transfer belt 31 when the trailing edge of the 50-line block enters the entrance of the secondary transfer nip.

Meanwhile, the target value of the offset current Ioff is changed to the value according to the image area ratio of the 50-line block of the intermediate transfer belt 31 when the leading edge of the 50-line block enters the exit of the secondary transfer nip. This configuration is based on the following reason. That is, if the offset current Ioff is insufficient at the exit of the secondary transfer nip, a transfer failure occurs, even if a sufficient offset current Ioff is supplied to the toner image at the entrance of the secondary transfer nip. In other words, if a sufficient offset current Ioff is supplied to the toner image at the exit of the secondary transfer nip, it is possible to favorably transfer the toner image onto the recording sheet P. For this reason, the target value of the offset current Ioff is changed at the above-described time.

When the target value of the peak-to-peak current Ipp is changed upon entry of the trailing edge of the 50-line block into the entrance of the secondary transfer nip, the leading edge of the 50-line block is still present in the secondary transfer nip. When the frequency of the AC component is represented as f (Hz), the nip length is represented as d (mm), the process linear velocity is represented as v (mm/s), and the length of the 50-line block in the belt moving direction R1 is represented as L (mm), the time taken from the time of change in the peak-to-peak current Ipp to the arrival of the leading edge of the 50-line block to the exit of the secondary transfer nip is represented as (d−L)/v. Thus, it is necessary to perform at least two cycles of back-and-forth movement of the toner during the time (d−L)/v. To perform this operation, the secondary transfer bias needs to satisfy a condition of $f*\{(d-L)/v\}\geq 2$. It is understood from a modification of the expression that the frequency f needs to be equal to or more than a value of $2/\{(d-L)/v\}$. In the printer 301, therefore, the secondary transfer bias power supply 39 is configured to output the AC component of the secondary transfer bias having the frequency f satisfying the condition of $f\geq 2/\{(d-L)/v\}$. For example, the frequency f of the AC component is set to approximately 1,000 Hz in the normal mode. In the normal mode, the nip length d is approximately 3 mm, the process linear velocity v is approximately 280 mm/s, and the length L of the 50-line block in the belt moving direction R1 is approximately 2.12 mm. Therefore, the time (d−L)/v is approximately 3.1 ms, and the number of oscillations of the AC component during the time (d−L)/v is calculated as $f*\{(d-L)/v\}$, i.e., approximately 3.1 times.

The present inventors prepared print test equipment similar in configuration to the printer 301 according to the first embodiment, and conducted the following first print test by using the print test equipment. That is, the print test used, as output images, three types of images having image area ratios in the 50-line block of approximately 50 percent, approximately 100 percent, and approximately 200 percent, respectively, in the entire area of the recording sheet P. Further, the print test used, as the recording sheet P, paper manufactured by Tokushu Paper Mfg. Co., Ltd. under the trade name Leathac 66 (260 kg type). Further, the print test employed the following four conditions as the conditions of the secondary transfer bias.

Figure 19:
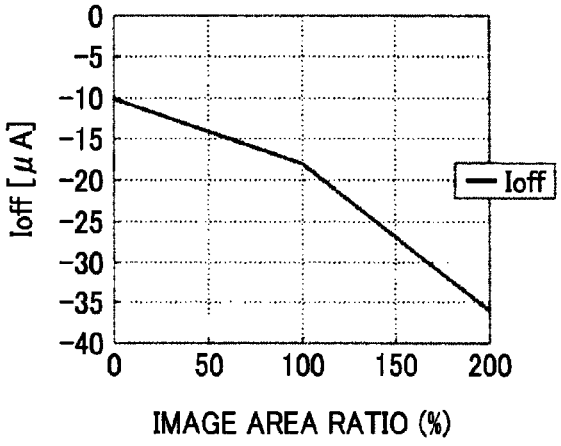
FIG. 19 is a graph illustrating a relation between an image area ratio and the offset current in the printer shown in FIG. 3 according to the first embodiment.
Figure 20:
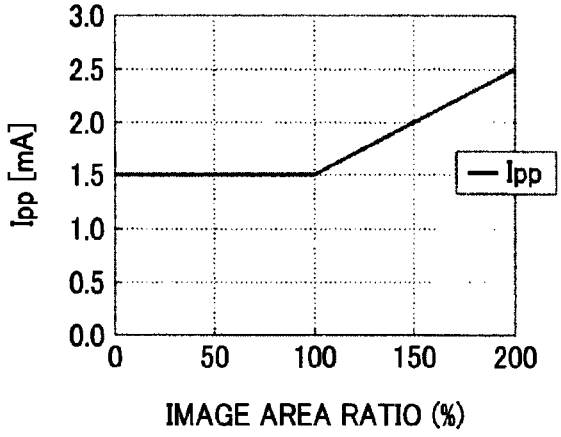
FIG. 20 is a graph illustrating a relation between the image area ratio and the peak-to-peak current in the printer shown in FIG. 3.

According to one of the four conditions, the offset current Ioff and the peak-to-peak current Ipp are respectively changed in accordance with the image area ratio of the 50-line block, similarly as in the printer 301 according to the first embodiment. The offset current Ioff was changed in accordance with the image area ratio of the 50-line block such that the offset current Ioff and the image area ratio had the relation as illustrated in FIG. 19. Further, the peak-to-peak current Ipp was changed in accordance with the image area ratio of the 50-line block such that the peak-to-peak current Ipp and the image area ratio had the relation as illustrated in FIG. 20.

According to another one of the four conditions, which is a first comparative example, the offset current Ioff is subjected to constant current control with a current of approximately −14 μA (microamperes), irrespective of the image area ratio. Further, the peak-to-peak current Ipp is subjected to constant current control with a current of approximately 1.5 mA (milliamperes), irrespective of the image area ratio. According to still another one of the four conditions, which is a second comparative example, the offset current Ioff is subjected to constant current control with a current of approximately −18 μA, irrespective of the image area ratio. Further, the peak-to-peak current Ipp is subjected to constant current control with a current of approximately 1.5 mA, irrespective of the image area ratio. According to the remaining one of the four conditions, which is a third comparative example, the offset current Ioff is subjected to constant current control with a current of approximately −36 μA, irrespective of the image area ratio. Further, the peak-to-peak current Ipp is subjected to constant current control with a current of approximately 2.7 mA, irrespective of the image area ratio.

The images output under the respective conditions were observed with the naked eye and evaluated by rank in terms of the appearance of white spots and the deficiency in image density in an image area on recesses in a sheet surface. The results of evaluation are presented in TABLE 1 given below. In TABLE 1, GOOD indicates that the appearance of white spots and the deficiency in image density were both hardly observed. Further, ACCEPTABLE indicates that the appearance of white spots or the deficiency in image density occurred to an extent slightly exceeding the acceptable level. Further, POOR indicates that the appearance of white spots or the deficiency in image density occurred to a substantial extent.

TABLE 1

| | Image area ratio (%) | | |
|---|---|---|---|
| Control method | 50 | 100 | 200 |
| First comparative example (Ioff of −14 μA and Ipp of 1.5 mA) | GOOD | ACCEPTABLE (Density) | POOR (Density) |
| Second comparative example (Ioff of −18 μA and Ipp of 1.5 mA) | ACCEPTABLE (White spots) | GOOD | POOR (Density) |
| Third comparative example (Ioff of −36 μA and Ipp of 2.7 mA) | POOR (White spots) | POOR (White spots) | GOOD |
| First embodiment | GOOD | GOOD | GOOD |

The test results indicate that, in the printer 301 according to the first embodiment, the appearance of white spots and the deficiency in image density were both favorably minimized on the recesses, irrespective of the image area ratio. Meanwhile, in the first comparative example, a favorable result was obtained in the image having the image area ratio of approximately 50 percent. However, a deficiency in image density exceeding the acceptable level occurred on the recesses in the sheet surface in the image having the image area ratio of approximately 100 percent. Further, a substantial deficiency in image density occurred on the recesses in the image having the image area ratio of approximately 200 percent. In the second comparative example, a favorable result was obtained in the image having the image area ratio of approximately 100 percent. However, white spots exceeding the acceptable level appeared in the image having the image area ratio of approximately 50 percent. Further, a substantial deficiency in image density occurred on the recesses in the image having the image area ratio of approximately 200 percent. In the third comparative example, a favorable result was obtained in the image having the image area ratio of approximately 200 percent. However, substantial white spots appeared in the image having the image area ratio of approximately 50 percent and the image having the image area ratio of approximately 100 percent.

As described above, the printer 301 employs the process linear velocity of approximately 280 mm/s in the normal mode. Meanwhile, in the high image quality mode, the process linear velocity is set to be lower than in the normal mode. Further, in the high-speed mode, the process linear velocity is set to be higher than in the normal mode. A change in process linear velocity results in a change in, for example, the amount of toner supplied to the secondary transfer nip per unit time and the amount of current supplied to the toner image in the secondary transfer nip. Further, a change in process linear velocity results in a change in the appropriate target output value, i.e., the appropriate target value of the offset current Ioff. If the process linear velocity is reduced, the absolute value of the target output value of the offset current Ioff needs to be reduced. In the case of constant voltage control, the absolute value of the offset voltage Voff similarly needs to be reduced in accordance with the reduction in the process linear velocity. In this case, the absolute value of the peak-to-peak voltage Vpp is similarly desired to be reduced in accordance with the reduction in the process linear velocity.

Further, if a toner charge amount per unit mass Q/M changes, the charge amount of the toner image changes, even if the toner adhesion amount per unit area in the toner image is the same. Thus, the potential of the toner in the secondary transfer nip changes, even if the toner adhesion amount is the same. Such a change, therefore, results in a change in the appropriate value of the offset current Ioff capable of minimizing the toner scattering and the deficiency in image density on the projections on the surface of the recording sheet and a change in the appropriate value of the peak-to-peak current Ipp capable of minimizing the appearance of white spots and the deficiency in image density on the recesses in the surface of the recording sheet. If the absolute value of the potential of the toner image is increased, the absolute value of the appropriate value of the offset current Ioff or the peak-to-peak current Ipp is also increased. The same applies to the offset voltage Voff and the peak-to-peak voltage Vpp in constant voltage control.

In view of the above, the controller 60 of the printer 301 according to the first embodiment is configured to perform a process of changing the respective target values of the offset current Ioff and the peak-to-peak current Ipp in accordance with the process linear velocity and the potential of the toner image, in addition to the image area ratio (i.e., the toner adhesion amount) of the 50-line block. The potential of the toner image is recognized on the basis of the result of detection by the above-described potential sensor 38. Functional expressions or data tables representing the graphs illustrated in FIGS. 19 and 20 may be stored specifically for respective process linear velocities and toner image potentials. In such a configuration, however, the amount of stored data is substantially large. In the first embodiment, therefore, the target value according to the image area ratio of the 50-line block is calculated by the functional expression, and thereafter the result of calculation is corrected on the basis of the process linear velocity and the potential of the toner image. The correction expression for the correction is obtained from previously conducted experiments, and is stored in the controller 60.

In the first embodiment, the area of the intermediate transfer belt 31 in which the toner adhesion amount is to be recognized is divided into the 50-line blocks. However, the size of each of the divided blocks is not limited to fifty lines. Further, the AC component having the sinusoidal waveform may be replaced by an AC component having one of various waveforms, such as rectangular, triangular, and trapezoidal waveforms.

Subsequently, description is given of a printer according to a second embodiment.

The printer according to the second embodiment is similar in configuration to the printer 301 according to the first embodiment, unless otherwise specified. The controller 60 of the printer according to the second embodiment is configured to perform constant voltage control on the DC component and the AC component of the secondary transfer bias. The controller 60 changes the target voltage value of the DC component, i.e., the target value of the offset voltage Voff as illustrated in FIG. 2, and the target voltage value of the AC component, i.e., the target value of the peak-to-peak voltage Vpp, in accordance with the image area ratio of the 50-line block, similarly as in the first embodiment.

Figure 21:
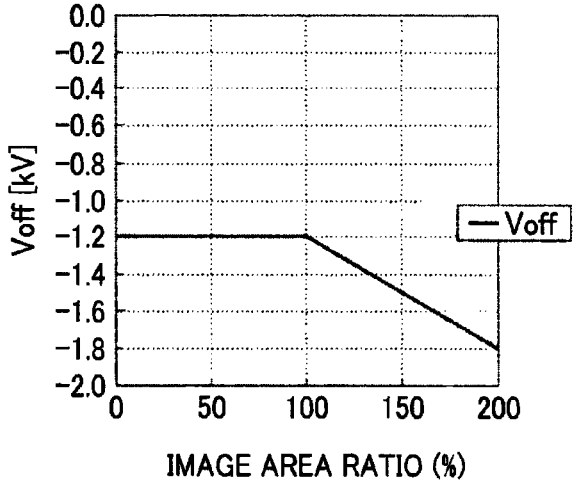
FIG. 21 is a graph illustrating a first example of a relation between the image area ratio and an offset voltage in a printer according to a second embodiment.
Figure 22:
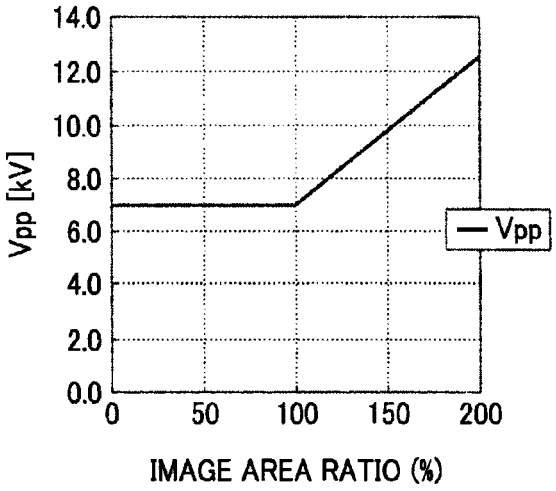
FIG. 22 is a graph illustrating a first example of a relation between the image area ratio and a peak-to-peak voltage in the printer according to the second embodiment.

FIG. 21 is a graph illustrating the relation between the image area ratio and the offset voltage Voff in the printer according to the second embodiment. FIG. 22 is a graph illustrating the relation between the image area ratio and the peak-to-peak voltage Vpp in the printer according to the second embodiment. The present inventors conducted a second print test under similar conditions as the conditions of the foregoing first print test, except that the offset voltage Voff and the peak-to-peak voltage Vpp are changed to have the above-described relations. The results of the print test are presented in TABLE 2 given below.

TABLE 2

| | Image area ratio (%) | | |
|---|---|---|---|
| Control method | 50 | 100 | 200 |
| Fourth comparative example (Voff of −1.2 kV and Vpp of 7 kV) | GOOD | GOOD | POOR (Density) |
| Fifth comparative example (Voff of −1.2 kV and Vpp of 7 kV) | GOOD | GOOD | POOR (Density) |
| Sixth comparative example (Voff of −1.8 kV and Vpp of 12.5 kV) | POOR (White spots) | POOR (White spots) | GOOD |
| Second embodiment | GOOD | GOOD | GOOD |

The test results indicate that, in the printer according to the second embodiment, the appearance of white spots and the deficiency in image density were both favorably minimized on the recesses, irrespective of the image area ratio. That is, it was proved that, even if the respective outputs of the DC component and the AC component of the secondary transfer bias are subjected to constant voltage control instead of constant current control, it is possible to favorably minimize both the appearance of white spots and the deficiency in image density on the recesses, irrespective of the image area ratio, by changing the target output value in accordance with the image area ratio. The test results also indicate that, if the target output value is unchanged and set to a constant value, irrespective of the image area ratio, the appearance of white spots or the deficiency in image density occurs on the recesses, as illustrated in the fourth to sixth comparative examples.

In the configuration of performing constant voltage control on the output of the DC component, however, if sheets of different electrical resistances or thicknesses are used as the recording sheet P, the value of the secondary transfer current varies, even if the same voltage is output as the DC component. As a result, a favorable result fails to be obtained. That is, the toner scattering or the deficiency in image density occurs on the projections on the surface of the recording sheet P, depending on the recording sheet P. For example, another print test similar to the second print test was conducted in which the 260 kg type of paper Leathac 66 (trade name) manufactured by Tokushu Paper Mfg. Co., Ltd. was replaced by the 175 kg type of paper Leathac 66 as the recording sheet P. In the print test, even if the target output value of the voltage of the DC component was changed in accordance with the image area ratio, the toner scattering or the deficiency in image density occurred in some cases on the projections on the surface of the recording sheet P. Meanwhile, in the configuration of performing constant current control on the DC component, the toner scattering or the deficiency in image density did not occur on the projections on the surface of the recording sheet P, even if the 175 kg type of paper Leathac 66 was used as the recording sheet P, when tested under similar conditions as the conditions of the first print test except for the difference in sheet. Accordingly, it is considered that the configuration of performing constant current control on the output of the DC component is superior to the configuration of performing constant voltage control on the output of the DC component.

Further, the same recording sheet P has different electrical resistances depending on the temperature and humidity. Therefore, it is difficult to recognize the accurate electrical resistance of the recording sheet P simply by referring to the type of the recording sheet P. Accordingly, it is difficult to recognize the appropriate value of the voltage output of the DC component, i.e., the offset voltage Voff, suitable for the recording sheet P simply by referring to the type of the recording sheet P. For example, if the electrical resistance of the recording sheet P is reduced in accordance with an environmental change, the appropriate value of the voltage output of the DC component is reduced. Meanwhile, the appropriate value of the voltage output of the AC component, i.e., the peak-to-peak voltage Vpp, is maintained at a substantially constant value owing to a time constant, irrespective of the electrical resistance of the recording sheet P and the temperature and humidity, particularly when the frequency is approximately a few hundred hertz or higher.

As described in the first embodiment, the respective appropriate values of the offset voltage Voff and the peak-to-peak voltage Vpp also vary in accordance with the process linear velocity and the potential of the toner image.

The printer according to the second embodiment, therefore, includes an information acquisition device for acquiring information of the electrical resistance and the thickness of the recording sheet P. For example, the combination of the control panel 50 and the controller 60 is employed as the information acquisition device. The controller 60 pre-stores the information of a plurality of sheet types in list format. Further, on the basis of an operation by the user, the controller 60 performs a process of causing the control panel 50 to display the sheet types in list format to allow the user to select the sheet type to be used. It is thereby possible to identify the sheet type to be used by the user, and to acquire the information of the electrical resistance and the thickness of the sheet.

The controller 60 is configured to perform a process of changing the offset voltage Voff on the basis of not only the image area ratio of the 50-line block but also the sheet type information acquired from the operation by the user on the control panel 50, the result of detection by the thermo-hygro sensor 85, the process linear velocity, and the potential of the toner image. The controller 60 is also configured to perform a process of changing the peak-to-peak voltage Vpp on the basis of not only the image area ratio of the 50-line block but also the process linear velocity and the potential of the toner image.

Figure 23:
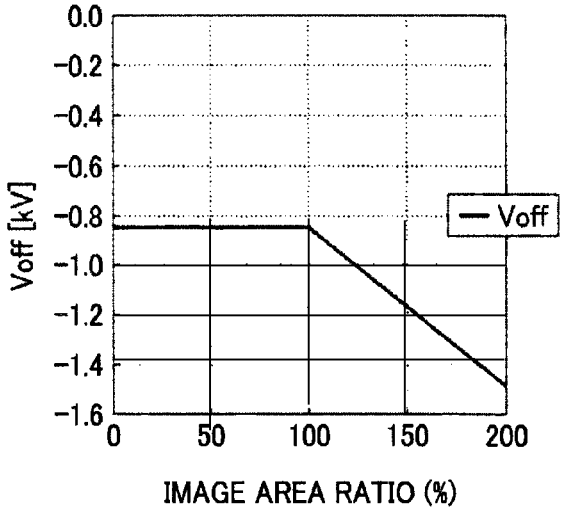
FIG. 23 is a graph illustrating a second example of a relation between the image area ratio and the offset voltage in the printer according to the second embodiment.
Figure 24:
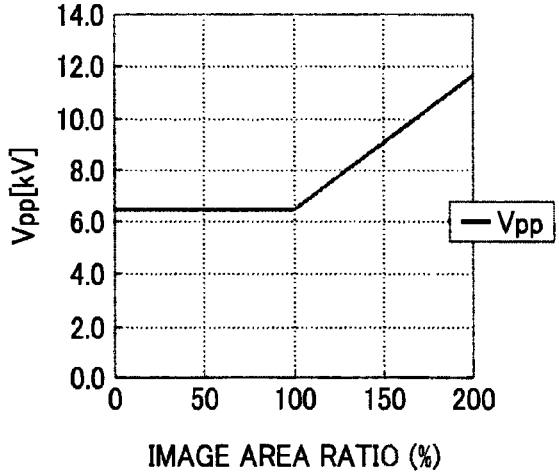
FIG. 24 is a graph illustrating a second example of a relation between the image area ratio and the peak-to-peak voltage in the printer according to the second embodiment.

Functional expressions or data tables representing the relation between the image area ratio of the 50-line block and the target value of the offset voltage Voff and specific to the respective sheet types are stored in the controller 60. For example, as for the 175 kg type of paper Leathac 66 (trade name), the controller 60 stores the correlations between the target output value and the image area ratio as illustrated in FIGS. 23 and 24. Further, in accordance with the result of detection of the temperature and humidity, the process linear velocity, and the potential of the toner image, the controller 60 corrects the target value of the offset voltage Voff specified in accordance with the image area ratio and the sheet type.

Figure 25:
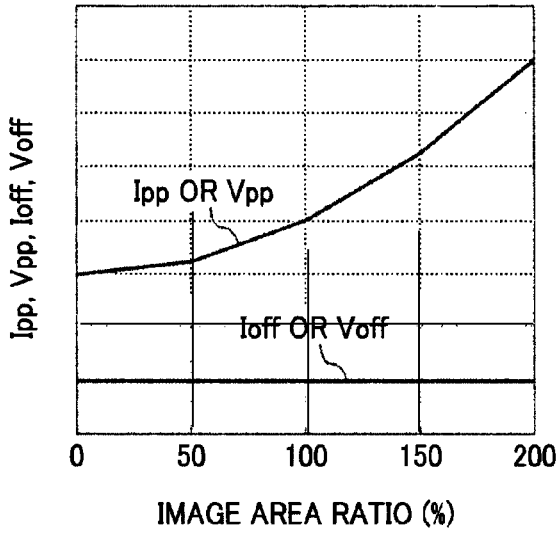
FIG. 25 is a graph illustrating the relation between the image area ratio and the target output value of the secondary transfer bias in a printer according to a reference embodiment.

In the first and second embodiments, description has been made of an example of changing both the target output value of the AC component and the target output value of the DC component in accordance with the image area ratio of the 50-line block. Alternatively, only the target output value of the AC component may be changed. According to experiments conducted by the present inventors, the effects of the above embodiments were also obtained by a configuration which uniformly sets the target output value of the DC component, i.e., the target value of the offset voltage Voff or the offset current Ioff, to a value equal to or slightly smaller than the value required to transfer a full solid image including two color toners, and which changes only the target output value of the AC component, i.e., the target value of the peak-to-peak voltage Vpp or the peak-to-peak current Ipp, in accordance with the image area ratio, as illustrated in FIG. 25.

Subsequently, description is given of printers according to respective examples, in each of which the printer 301 according to the first or second embodiment is added with a more characteristic configuration.

The printers according to the respective examples are similar in configuration to the printer 301 according to the first or second embodiment, unless otherwise specified.

A first example will now be described. A printer according to the first example is basically similar in configuration to the printer 301 according to the first or second embodiment. The present example is different from the first or second embodiment in that the controller 60 performs a process of outputting to the secondary transfer bias power supply 39 a control signal for changing the frequency f of the AC component of the secondary transfer bias in accordance with the process linear velocity. Specifically, if the process linear velocity is changed and thereby the secondary transfer bias fails to satisfy the above-described condition of $f \geq 2/\{(d-L)/v\}$, the controller 60 outputs a control signal for correcting the frequency f to a stored value. The secondary transfer bias power supply 39 corrects the frequency f of the AC component in accordance with the control signal received from the controller 60.

According to the present configuration, even if the process linear velocity is changed, the secondary transfer bias satisfies the condition of $f \geq 2/\{(d-L)/v\}$, irrespective of the process linear velocity. Accordingly, the present configuration is capable of reliably causing a desired number of back-and-forth movements of the toner between the intermediate transfer belt 31 and the recesses in the surface of the recording sheet P in the secondary transfer nip.

Subsequently, a second example will be described.

A printer according to the second example acquires the sheet type information from the operation by the user on the control panel 50, similarly as in the printer according to the second embodiment. Further, the printer of the second example outputs the secondary transfer bias from the secondary transfer bias power supply 39 under constant current control or constant voltage control.

The printer according to the second example is different from the printer 301 according to the first or second embodiment in that the degree of irregularity of the surface of the recording sheet P is recognized on the basis of the acquired sheet type information, and that, in the case of a sheet type not substantially large in the degree of irregularity (e.g., plain paper sheet), a secondary transfer bias including only the DC component is output in place of the secondary transfer bias including the superimposed bias. This is because, in the case of a sheet type not substantially large in the degree of irregularity, the appearance of white spots and the deficiency in image density hardly occur on the recesses. According to the present configuration, if a sheet type not substantially large in the degree of irregularity is used, i.e., if there is little possibility of causing the appearance of white spots and the deficiency in image density on the recesses in the surface of the recording sheet P, the secondary transfer bias including only the DC component is employed. Thereby, power consumption is minimized.

The target output value of the DC component, i.e., the target value of the offset current Ioff or the offset voltage Voff, is changed in accordance with the image area ratio of the 50-line block. Accordingly, the toner scattering and the deficiency in image density are minimized irrespective of the image area ratio.

Subsequently, a third example will be described.

A printer according to the third example is configured to determine whether or not to set the mode for outputting the secondary transfer bias including only the DC component, not on the basis of the sheet type information acquired from the operation on the control panel 50, but on the basis of the operation by the user. That is, the user sets whether or not to set the mode for outputting the secondary transfer bias including only the DC component.

According to the present configuration, when the user uses a sheet type not substantially large in the degree of irregularity, the user sets the above-described mode through the operation on the control panel 50 serving as an information acquisition device that acquires the degree of irregularity of the surface of the recording sheet. Thereby, the secondary transfer bias including only the DC component is employed, and power consumption is minimized.

Subsequently, a fourth example will be described.

The present inventors found from experiments that a change in the depth of the recesses in the surface of the recording sheet P results in a change in the value of the peak-to-peak current Ipp or the peak-to-peak voltage Vpp capable of reliably causing the toner to move back and forth between the intermediate transfer belt 31 and the recesses in the surface of the recording sheet P in the secondary transfer nip. Specifically, the deeper is the recesses, the larger is the value of the peak-to-peak current Ipp or the peak-to-peak voltage Vpp required to cause the back-and-forth movement of the toner.

In view of the above, a printer according to the fourth example is configured to change, for each sheet type, the functional expression representing the relation between the image area ratio and the target value of the peak-to-peak current Ipp or the peak-to-peak voltage Vpp so as to set the appropriate value of the peak-to-peak current Ipp or the peak-to-peak voltage Vpp in accordance with the depth of the recesses in the surface of the sheet type acquired from the operation by the user on the control panel 50. According to the present configuration, the appearance of white spots and the deficiency in image density on the recesses in the surface of the recording sheet P are minimized irrespective of the depth of the recesses.

Subsequently, a fifth example will be described.

Figure 26:
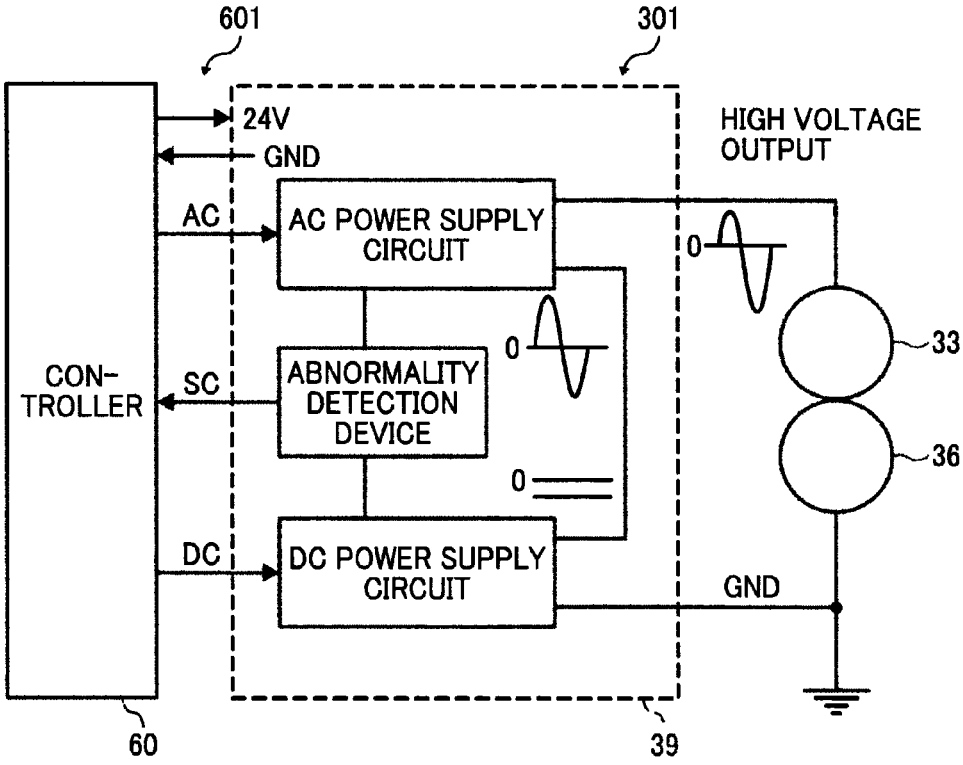
FIG. 26 is a block diagram illustrating a transfer bias generator of the printer according to the first embodiment, as well as rollers forming the secondary transfer nip.

FIG. 26 is a block diagram illustrating the internal configuration of the secondary transfer bias power supply 39 of a transfer bias generator 601 (i.e., the combination of the controller 60 and the secondary transfer bias power supply 39) of the printer 301 according to the first embodiment, as well as the secondary transfer inner surface roller 33 and the nip formation roller 36 forming the secondary transfer nip. In the drawing, illustration of the recording sheet P and the intermediate transfer belt 31 is omitted for convenience. In the secondary transfer bias power supply 39 of the printer 301 according to the first embodiment, an AC power supply circuit for outputting the AC component and a DC power supply circuit for outputting the DC component are connected in series. The outputs from the power supply circuits are connected to the secondary transfer inner surface roller 33 and the nip formation roller 36 acting as a load. A ground (GND) voltage and a power supply voltage of approximately 24 V for driving the secondary transfer bias power supply 39 are supplied to the secondary transfer bias power supply 39 from the controller 60 via an interlock switch. Further, the secondary transfer bias power supply 39 is connected to an AC output and a DC output of a start signal. The AC power supply circuit and the DC power supply circuit are connected to an abnormality detection device which outputs an abnormality detection signal SC of the power supply output to the controller 60. With this configuration, the load is applied with an AC voltage superimposed on a DC voltage.

Figure 27:
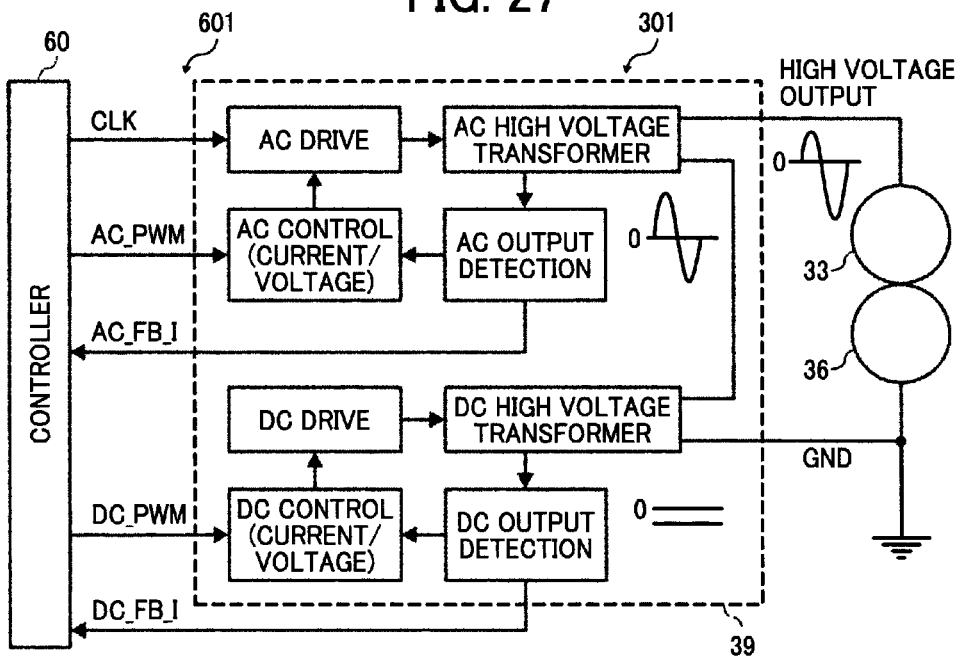
FIG. 27 is a block diagram illustrating a transfer bias generator of a printer according to a fifth example, as well as rollers forming the secondary transfer nip.

FIG. 27 is a block diagram illustrating the transfer bias generator 601 (i.e., the combination of the controller 60 and the secondary transfer bias power supply 39) of the printer 301 according to the fifth example, as well as the secondary transfer inner surface roller 33 and the nip formation roller 36 forming the secondary transfer nip. In the drawing, illustration of abnormality detection and power supply input used in the operation of the secondary transfer bias power supply 39 is omitted. A circuit for outputting the AC component is constructed of an AC drive block, an AC high voltage transformer block, an AC output detection block, and an AC control block. Further, a circuit for outputting the DC component is constructed of a DC drive block, a DC high voltage transformer block, a DC output detection block, and a DC control block. A signal CLK for setting the frequency of the AC voltage is supplied to the secondary transfer bias power supply 39 by the controller 60. The circuit for the AC component is connected to a signal AC_PWM for setting the current or voltage of the AC output and a signal AC_FB_I for monitoring the AC output. Similarly, the circuit for the DC component is connected to a signal DC_PWM for setting the current or voltage of the DC output to be superimposed on the AC output and a signal DC_FB_I for monitoring the DC output. As for the control of each of the AC and DC components, on the basis of a command transmitted from the controller 60, a signal for controlling the driving of the AC or DC high voltage transformer block is output via the AC or DC drive block such that a detection signal from the AC or DC output detection block is adjusted to a predetermined value.

The AC control block controls the current and voltage of the AC output, and the AC output detection block detects both the output current and the output voltage to allow both constant current control and constant voltage control. The same applies to the DC control block. Normally, both the AC control block and the DC control block preferentially control the current detection value to perform constant current control. The present configuration uses the detection value of the output voltage to minimize the upper limit voltage, and controls the maximum voltage in, for example, a no-load state. Further, the monitor signals from the AC and DC output detection blocks are input to the controller 60 as information for monitoring the load state. In the present example, the frequency of the AC voltage is set by a signal CLK transmitted from the controller 60. Alternatively, a fixed frequency may be generated in the circuit for outputting the AC voltage.

According to the present configuration, it is possible to switch between constant current control and constant voltage control on the basis of the instruction from the user. Further, between the circuit for outputting the DC voltage and the circuit for outputting the AC voltage, the circuit for outputting the AC voltage can be stopped to switch between the mode for outputting the secondary transfer bias including only the DC component and the mode for outputting the secondary transfer bias including the DC component and the AC component.

Subsequently, a sixth example will be described.

Figure 28:
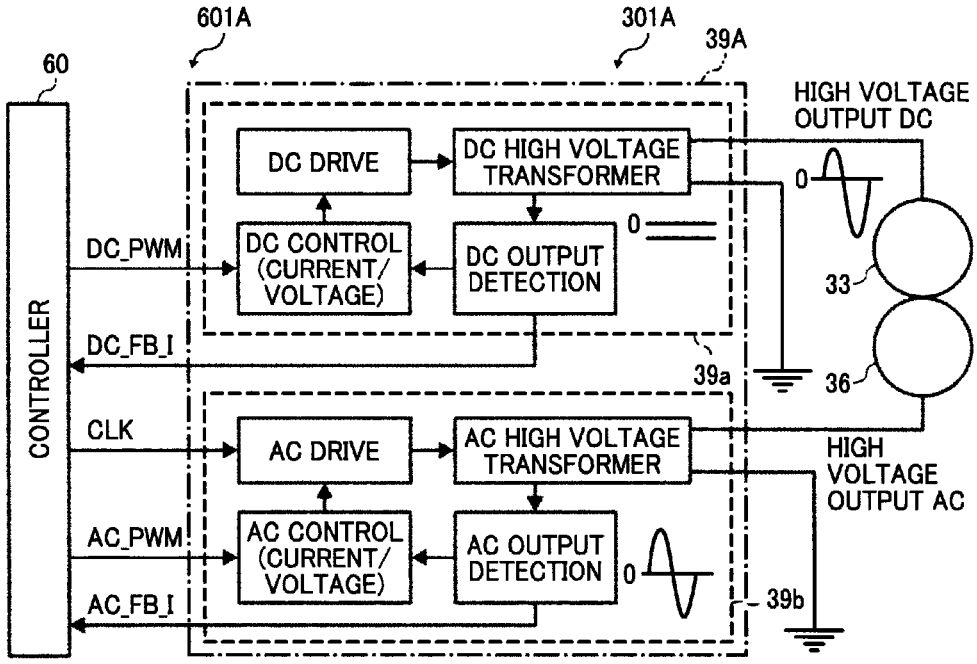
FIG. 28 is a block diagram illustrating a transfer bias generator of a printer according to a sixth example, as well as rollers forming the secondary transfer nip.

FIG. 28 is a block diagram illustrating a transfer bias generator 601A (i.e., the combination of the controller 60 and a secondary transfer bias power supply 39A) of a printer 301A according to the sixth example, as well as the secondary transfer inner surface roller 33 and the nip formation roller 36 forming the secondary transfer nip. The present example includes a first power supply circuit 39*a*, serving as a first power supply, for outputting only the DC component and a second power supply circuit 39*b*, serving as a second power supply, for outputting the DC component and the AC component. With this configuration, it is possible to switch between the mode for outputting the secondary transfer bias including only the DC component and the mode for outputting the secondary transfer bias including the DC component and the AC component. The first power supply circuit 39*a* is normally provided in a commonly used printer. It is therefore possible to improve the transfer bias generator of a commonly used printer into the transfer bias generator 601A of the printer 301A according to the example of the present invention, simply by adding the second power supply circuit 39*b* to the existing first power supply circuit 39*a*.

Subsequently, a seventh example will be described.

Figure 29:
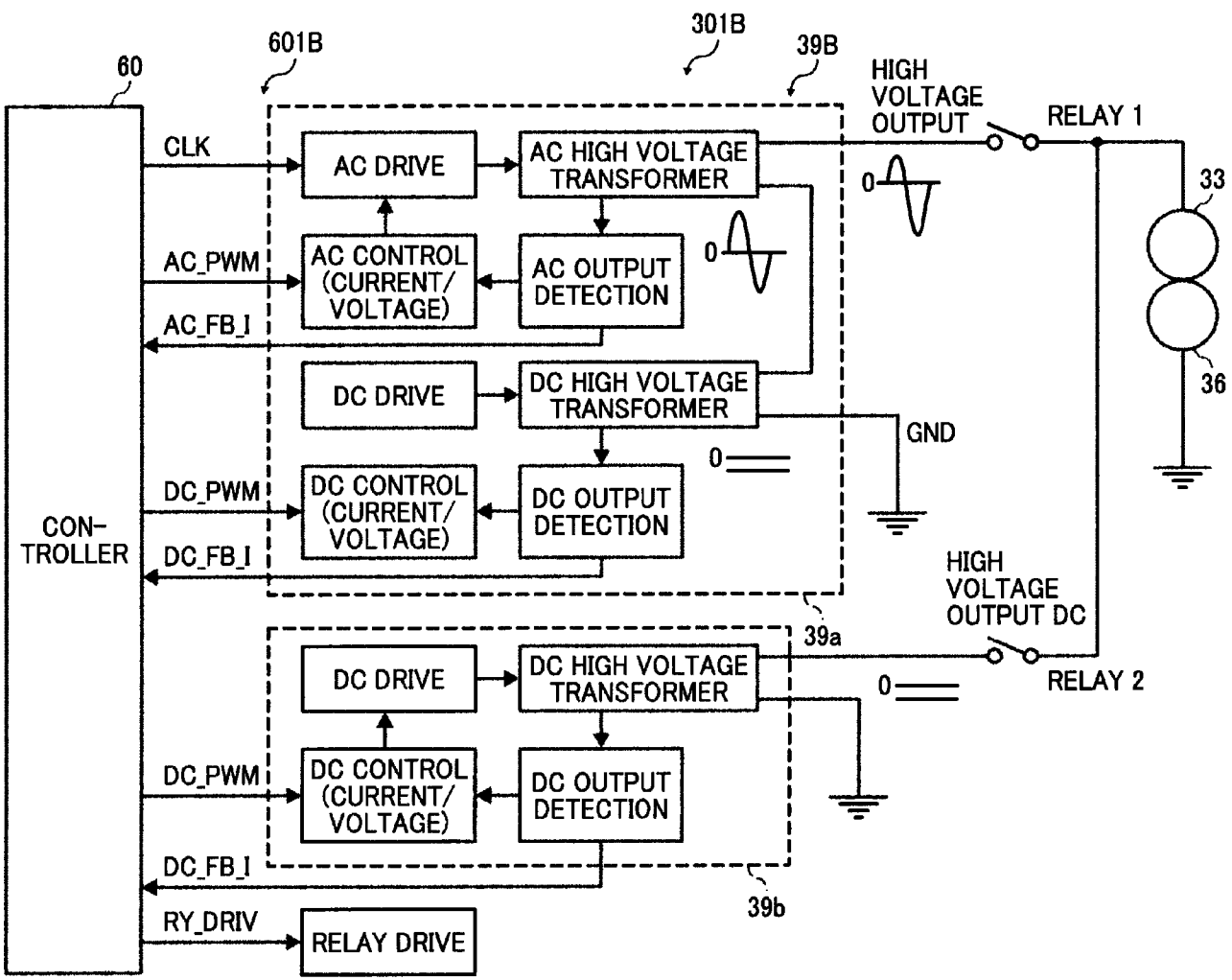
FIG. 29 is a block diagram illustrating a transfer bias generator of a printer according to a seventh example, as well as rollers forming the secondary transfer nip.

FIG. 29 is a block diagram illustrating a transfer bias generator 601B (i.e., the combination of the controller 60 and a secondary transfer bias power supply 39B) of a printer 301B according to the seventh example, as well as the secondary transfer inner surface roller 33 and the nip formation roller 36 forming the secondary transfer nip. The present example fulfills a similar function to the function of the transfer bias generator 601 of FIG. 27. Further, it is possible to switch between the above-described two modes by using only the existing power supply to output the secondary transfer bias including only the DC component and using the newly provided power supply to output the secondary transfer bias including the DC component and the AC component. The present example is configured to use relays 1 and 2 to switch the voltage to be applied to the secondary transfer inner surface roller 33. The first power supply circuit 39*a* generates the AC-DC superimposed voltage, and the second power supply circuit 39*b* generates the normal voltage including only the DC component. Switching of the output voltage by the use of the relays 1 and 2 is performed by a control signal RY_DRIV output from the controller 60.

FIG. 29 illustrates an example using contact switching elements of the relays 1 and 2 as switching devices. Other switching elements using semiconductors, such as FETs (Field-Effect Transistors), for example, also fulfill a similar function to the function of the contact switching elements of the relays 1 and 2. In the illustrated example, the first power supply circuit 39*a* and the second power supply circuit 39*b* are configured as separate circuits. It is therefore possible to optionally install only the first power supply circuit 39*a*.

Subsequently, an eighth example will be described.

Figure 30:
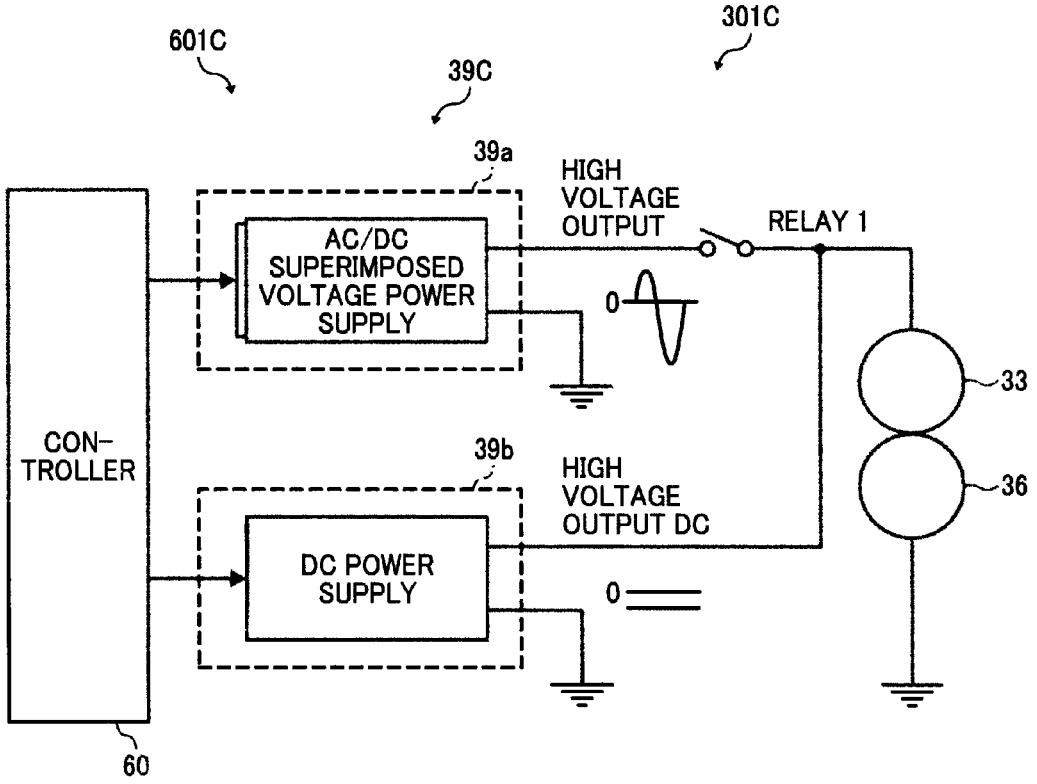
FIG. 30 is a block diagram illustrating a transfer bias generator of a printer according to an eighth example, as well as rollers forming the secondary transfer nip.

FIG. 30 is a block diagram illustrating a transfer bias generator 601C (i.e., the combination of the controller 60 and a secondary transfer bias power supply 39C) of a printer 301C according to the eighth example, as well as the secondary transfer inner surface roller 33 and the nip formation roller 36 forming the secondary transfer nip. In the present example, switching between the secondary transfer bias including only the DC component and the secondary transfer bias including the AC-DC superimposed voltage is performed solely by the relay 1. When the contact of the relay 1 is closed to output the AC-DC superimposed voltage from the first power supply circuit 39*a*, the second power supply circuit 39*b* connected in parallel to the first power supply circuit 39*a* is also applied with the voltage. Therefore, the second power supply circuit 39*b* acts as a load on the first power supply circuit 39*a*. If the adverse effect caused by the current supply to the second power supply circuit 39*b* is relatively small, it is possible to employ the present example to simplify the circuit and reduce costs.

Subsequently, a ninth example will be described.

Figure 31:
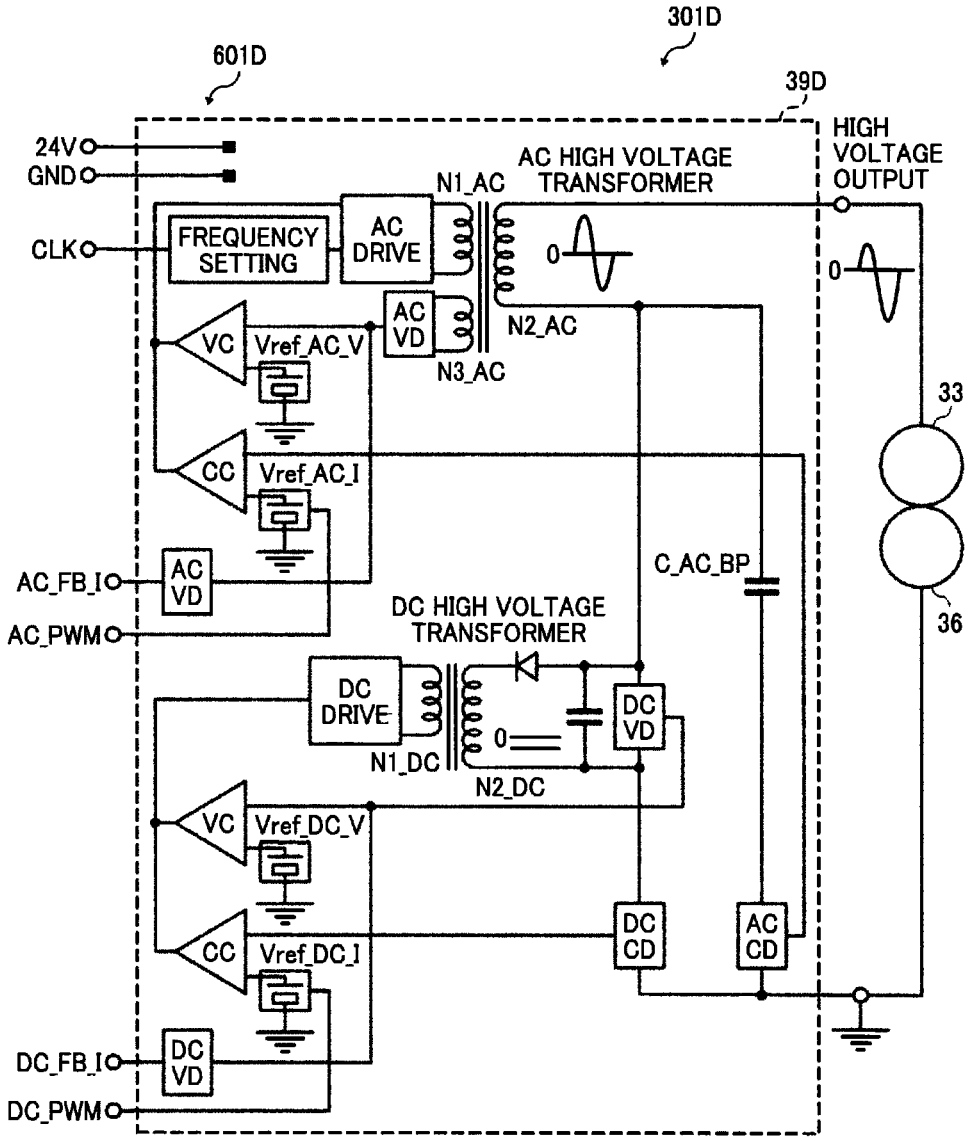
FIG. 31 is a block diagram illustrating a secondary transfer bias power supply of a printer according to a ninth example, as well as rollers forming the secondary transfer nip.

FIG. 31 is a block diagram illustrating a transfer bias generator 601D (i.e., the combination of the controller 60 and a secondary transfer bias power supply 39D) of a printer 301D according to the ninth example, as well as the secondary transfer inner surface roller 33 and the nip formation roller 36 forming the secondary transfer nip. In the drawing, the controller 60 that constitutes the transfer bias generator 601D together with the secondary transfer bias power supply 39D is omitted.

An AC voltage circuit in the upper half part and a DC voltage circuit in the lower half part both perform constant current control. As for the AC voltage, a relatively low voltage approximate to the output from the AC high voltage transformer block is extracted by a coil N3_AC, and is compared with a reference signal Vref_AC_V by a voltage control (VC) block. Meanwhile, the AC current is extracted by an AC current detector (ACCD) provided between the ground and a capacitor C_AC_BP which biases an AC component connected in parallel to the output from the DC voltage circuit, and is compared with a reference signal Vref_AC_I by a current control (CC) block. The level of the reference signal Vref_AC_I is set in accordance with a setting signal AC_PWM of the AC output current. The output from the voltage control block is set to the level of the reference signal Vref_AC_V such that the output becomes effective when the output voltage is increased to reach or exceed a predetermined value, e.g., in the no-load state. Meanwhile, the output from the current control block is set to the level of the reference signal Vref_AC_I such that the output becomes effective under a normal load. According to the present configuration, the high voltage output current is switched in accordance with the state of the load, e.g., in accordance with the material of the secondary transfer inner surface roller 33 or the nip formation roller 36. The output from the voltage control block or the current control block is input to the AC drive block, and the AC high voltage transformer block is driven in accordance with the level of the output. Similarly, the DC voltage circuit detects both the output voltage and the output current. The voltage is extracted by a DC voltage detector (DCVD) connected in parallel to a rectifying and smoothing circuit provided to an output coil N2_DC of the DC high voltage transformer block. The current is extracted by a DC current detector (DCCD) connected between the ground and the output coil N2_DC. Respective detection signals of the voltage and the current are compared with reference signals Vref_DC_V and Vref_DC_I, which are weighted similarly as in the AC component. Thereby, the DC component of the high voltage output is controlled.

Subsequently, description is given of modified examples of the first or second embodiment.

Printers according to the modified examples are similar in configuration to the first or second embodiment, unless otherwise specified.

A first modified example will now be described.

Figure 32:
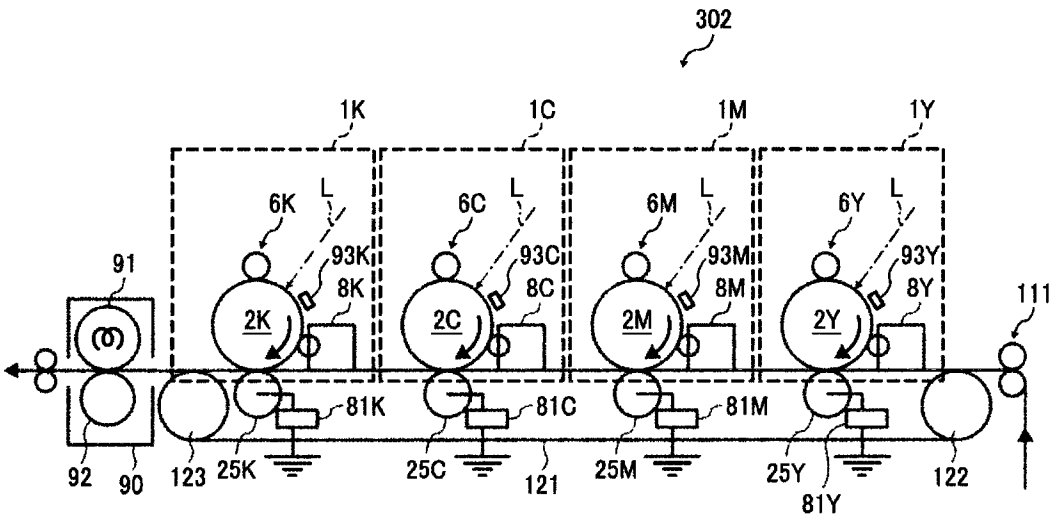
FIG. 32 is a schematic configuration diagram illustrating a printer according to a first modified example and a printer according to a second modified example.

FIG. 32 is a schematic configuration diagram illustrating a printer 302 according to the first modified example. The printer 302 is a direct transfer tandem-type color printer which directly transfers yellow, magenta, cyan, and black toner images formed on the photoconductors 2Y, 2M, 2C, and 2K, serving as a first rotary body, onto a recording sheet. In the direct transfer color printer 302, the recording sheet is conveyed to a sheet conveying belt 121, serving as an image carrier looped over rollers 122 and 123, by sheet feeding rollers 111. Then, the yellow, magenta, cyan, and black toner images visualized by the development devices 8Y, 8M, 8C, and 8K are sequentially and directly transferred onto the recording sheet from the drum-shaped photoconductors 2Y, 2M, 2C, and 2K. Thereafter, the yellow, magenta, cyan, and black toner images are fixed on the recording sheet by the fixing device 90. An AC-DC superimposed voltage is employed as the primary transfer bias applied to primary transfer rollers 25Y, 25M, 25C, and 25K for the respective colors serving as a second rotary body from the primary transfer bias power supplies 81Y, 81M, 81C, and 81K serving as a transfer bias supply. It is thereby possible to primarily transfer toner to recesses in a surface of the recording sheet favorably, even if the recording sheet is made of Japanese paper with relatively large irregularities. The respective target output values of the DC component and the AC component of the primary transfer bias are changed in accordance with the image area ratio of the 50-line block on each of the photoconductors 2Y, 2M, 2C, and 2K.

Subsequently, a second modified example will be described.

FIG. 32 described above is a schematic configuration diagram also illustrating the printer 302 according to the second modified example. The printer 302 is different from the printer 301 according to the first and second embodiments in that the endless sheet conveying belt 121 replaces the intermediate transfer belt 31, and is brought into contact with the photoconductors 2Y, 2M, 2C, and 2K for the respective colors serving as a first rotary body. The sheet conveying belt 121 carries the recording sheet on a surface thereof, and sequentially passes the recording sheet through primary transfer nips formed between the photoconductors 2Y, 2M, 2C, and 2K and the sheet conveying belt 121 in accordance with the rotational movement of the sheet conveying belt 121. In this process, the Y, M, C, and K toner images on the photoconductors 2Y, 2M, 2C, and 2K are transferred onto the surface of the recording sheet in a superimposed manner.

The image forming units 1Y, 1M, 1C, and 1K include potential sensors 93Y, 93M, 93C, and 93K, respectively, each of which detects the potential of the electrostatic latent image formed on the surface of the corresponding one of the photoconductors 2Y, 2M, 2C, and 2K with laser light L applied thereto. Each of the potential sensors 93Y, 93M, 93C, and 93K may be a surface potential sensor EFS-22D manufactured by TDK Corporation, and is disposed opposite the surface of the corresponding one of the photoconductors 2Y, 2M, 2C, and 2K via a gap of approximately 4 mm.

Inside the loop of the sheet conveying belt 121, the primary transfer rollers 25Y, 25M, 25C, and 25K for the Y, M, C, and K colors, serving as a second rotary body, come into contact with an inner circumferential surface of the sheet conveying belt 121 to press the sheet conveying belt 121 serving as an image carrier against the photoconductors 2Y, 2M, 2C, and 2K serving as a first rotary body. The primary transfer bias power supplies 81Y, 81M, 81C, and 81K, serving as a transfer bias supply, supply a transfer bias to the primary transfer rollers 25Y, 25M, 25C, and 25K.

In the printer 302 according to the second modified example, the chargers 6Y, 6M, 6C, and 6K for uniformly charging the respective surfaces of the photoconductors 2Y, 2M, 2C, and 2K, an optical writer for performing optical writing on the uniformly charged surfaces of the photoconductors 2Y, 2M, 2C, and 2K, and the primary transfer rollers 25Y, 25M, 25C, and 25K constitute potential difference generators for the respective colors of Y, M, C, and K. The potential difference generators generate, between the electrostatic latent images on the photoconductors 2Y, 2M, 2C, and 2K and respective cores of the primary transfer rollers 25Y, 25M, 25C, and 25K pressed against the photoconductors 2Y, 2M, 2C, and 2K, a potential difference including a DC component and an AC component.

The configuration of brining the sheet conveying belt 121 into contact with the photoconductors 2Y, 2M, 2C, and 2K may be replaced by a configuration of bringing the primary transfer rollers 25Y, 25M, 25C, and 25K into direct contact with the photoconductors 2Y, 2M, 2C, and 2K, respectively, to form the primary transfer nips for the Y, M, C, and K colors. In this case, the primary transfer rollers 25Y, 25M, 25C, and 25K function as a second rotary body.

Similarly as in the first and second embodiments, the secondary transfer bias power supply 39 and the controller 60 change the respective target output values of the DC component and the AC component in accordance with the image area ratio of the 50-line block of the sheet conveying belt 121.

Subsequently, a third modified example will be described.

Figure 33:
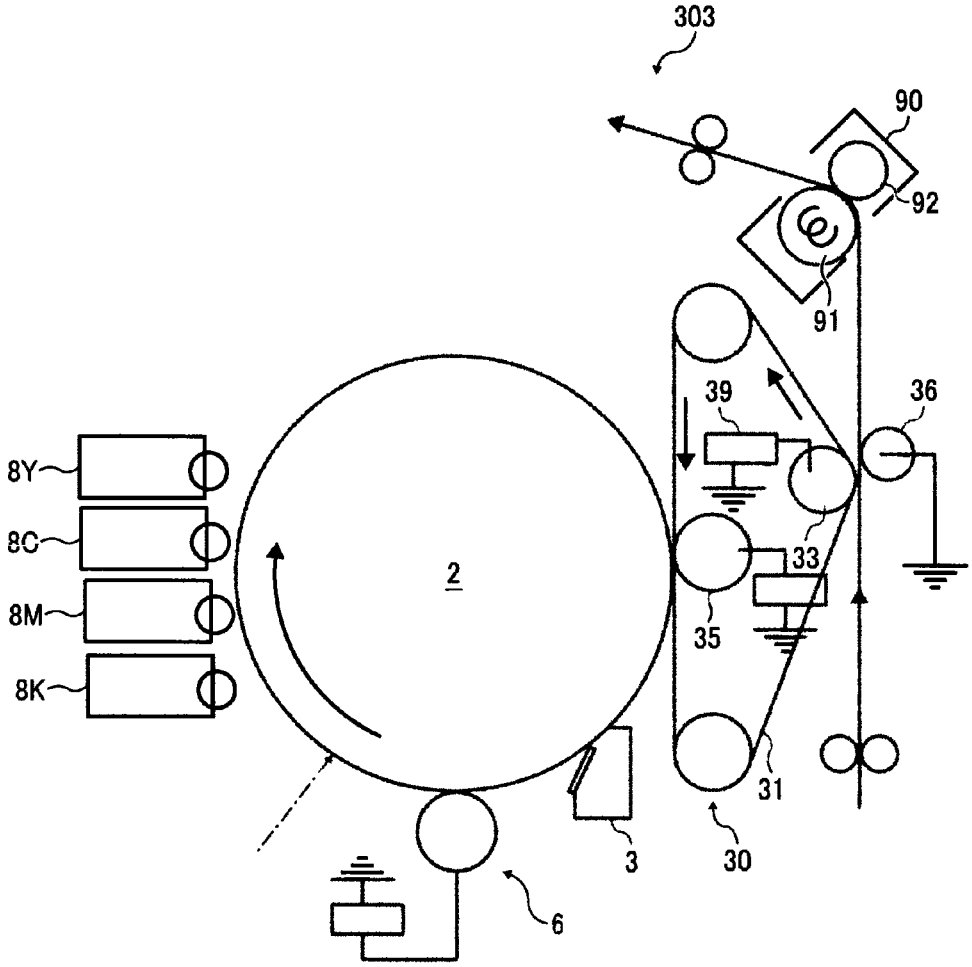
FIG. 33 is a schematic configuration diagram illustrating a printer according to a third modified example.

FIG. 33 is a schematic configuration diagram illustrating a printer 303 according to the third modified example. Unlike the printer 301 illustrated in FIG. 3, the printer 303 includes a single photoconductor 2, four development devices 8Y, 8C, 8M, and 8K disposed opposite the photoconductor 2, and a single primary transfer roller 35.

In an image forming operation, an outer circumferential surface of the photoconductor 2 is uniformly charged by a charger 6. Thereafter, laser light modified on the basis of image data for the Y color is applied to the outer circumferential surface of the photoconductor 2 to form an electrostatic latent image for the Y color on the outer circumferential surface of the photoconductor 2. Then, the electrostatic latent image for the Y color is developed into a Y toner image by the development device 8Y, and the Y toner image is primarily transferred onto the intermediate transfer belt 31. Thereafter, post-transfer residual toner remaining on the outer circumferential surface of the photoconductor 2 is removed by a photoconductor cleaner 3, and the outer circumferential surface of the photoconductor 2 is again uniformly charged by the charger 6. Then, laser light modified on the basis of image data for the C color is applied to the outer circumferential surface of the photoconductor 2 to form an electrostatic latent image for the C color on the outer circumferential surface of the photoconductor 2. Thereafter, the electrostatic latent image for the C color is developed into a C toner image by the development device 8C. Then, the C toner image is primarily transferred to be superimposed on the Y toner image on the intermediate transfer belt 31. Thereafter, an M toner image and a K toner image are sequentially developed on the outer circumferential surface of the photoconductor 2, and are sequentially primarily transferred to be superimposed on the Y and C toner images on the intermediate transfer belt 31. Thereby, a four-color superimposed toner image is formed on the intermediate transfer belt 31.

Thereafter, the toner images included in the four-color superimposed toner image on the intermediate transfer belt 31 are secondarily transferred onto a surface of a recording sheet at the same time in the secondary transfer nip. Thereby, a full-color image is formed on the recording sheet. Then, the full-color image is fixed on the recording sheet by the fixing device 90, and the recording sheet is discharged outside the printer 303.

With this configuration, the intermediate transfer belt 31 serves as an image carrier; the nip formation roller 36 serves as a first rotary body; the secondary transfer inner surface roller 33 serves as a second rotary body; and the secondary transfer bias power supply 39 serves as a transfer bias supply.

The characteristic configurations of the present invention described above are also applicable to the printer 303 having the above-described structure.

The above description has been made of examples of application of the present invention to the secondary transfer nip formed by the contact of the intermediate transfer belt 31 serving as an image carrier and the nip formation roller 36 serving as a first rotary body. The present invention is also applicable to a primary transfer nip as described below. That is, an inner surface contact member is brought into contact with an inner circumferential surface of an endless belt-shaped photoconductor serving as an image carrier, and the endless belt-shaped photoconductor is pressed against a nip forming rotary body to bring the photoconductor and the nip forming rotary body into contact with each other. Thereby, the primary transfer nip is formed.

The above description has been made of examples of application of the present invention to the electrophotographic printer. The present invention is also applicable to an image forming apparatus which forms a color image in a direct recording method. The direct recording method forms a pixel image not by using a latent image carrier but by using a toner jetting device which jets toners in dots such that the toners directly adhere to a recording sheet or an intermediate recording body. Thereby, a toner image is directly formed on the recording sheet or the intermediate recording body. The method has been used in background image forming apparatuses. The present invention is also applicable to a transfer nip for transferring the toner image onto the recording sheet from the intermediate recording body serving as an image carrier.

Further, the present invention is also applicable to an image forming apparatus which may be a copier, a facsimile machine, a printer, a multifunction printer having at least one of copying, printing, scanning, plotter, and facsimile functions, or the like, that forms a monochrome toner image, a color toner image, or both.

According to the above-described embodiments, when the adhesion amount recognition device (e.g., the controller 60) recognizes that the toner adhesion amount in the region on the image carrier (e.g., the intermediate transfer belt 31) entering the secondary transfer nip is relatively greater, the transfer bias generator (e.g., the secondary transfer bias power supply 39, 39A, 39B, 39C, or 39D and the controller 60) outputs a relatively increased AC component of the secondary transfer bias. Accordingly, even if a relatively greater amount of toner is present in the secondary transfer nip, an electric field generates which is great enough to move the toner back and forth between the outer circumferential surface of the image carrier and the recesses in the surface of the recording sheet in the secondary transfer nip, thus attaining sufficient image density on the recesses in the surface of the recording sheet.

Conversely, when the adhesion amount recognition device recognizes that a relatively smaller amount of toner is present in the secondary transfer nip, the transfer bias generator outputs a relatively decreased AC component of the secondary transfer bias, thus decreasing the transferring peak value of the AC component. As a result, discharge is minimized in the recesses in the surface of the recording sheet, and white spots are minimized on the toner image on the recesses in the surface of the recording sheet.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming apparatus comprising:

an image carrier movable in a predetermined moving direction and to carry a toner image;

a first rotary body to contact an outer surface of the image carrier;

a second rotary body pressed against an inner surface of the image carrier to form a transfer nip between the outer surface of the image carrier and the first rotary body; and a transfer bias generator to output to the second rotary body a transfer bias including a direct current component and an alternating current component for application to the image carrier to transfer the toner image from the image carrier onto a recording medium conveyed through the transfer nip, the transfer bias generator including:

a transfer bias supply operatively connected to the second rotary body to supply the transfer bias including at least the alternating current component thereto; and a controller operatively connected to the transfer bias supply to detect a toner adhesion amount at a predetermined region of the image carrier located immediately upstream from the transfer nip and having a predetermined length in the moving direction of the image carrier, the transfer bias generator outputting at least the alternating current component under one of constant voltage control and constant current control and changing a target output value of the alternating current component separately from the direct current component from a non-zero value to another non-zero value according to the toner adhesion amount detected by the controller.

2. The image forming apparatus according to claim 1, wherein the image carrier includes an endless intermediate transfer belt having a modulus of elongation of at least approximately 2 giga Pascals.

3. The image forming apparatus according to claim 1, further comprising an electric potential detector disposed opposite the image carrier to detect an electric potential of the toner image formed on the image carrier, wherein the transfer bias generator changes the target output value of the alternating current component under one of constant voltage control and constant current control according to a combination of the electric potential of the toner image detected by the electric potential detector and the toner adhesion amount detected by the controller.

4. The image forming apparatus according to claim 1, wherein a polarity of the transfer bias alternates between positive and negative.

5. The image forming apparatus according to claim 1, wherein the transfer bias generator increases the target output value of the alternating current component as the toner adhesion amount detected by the controller increases.

6. An image forming apparatus comprising:

an image carrier movable in a predetermined moving direction and to carry a toner image;

a first rotary body to contact an outer surface of the image carrier;

a second rotary body pressed against an inner surface of the image carrier to form a transfer nip between the outer surface of the image carrier and the first rotary body; and a transfer bias generator to output to the second rotary body a transfer bias including a direct current component and an alternating current component for application to the image carrier to transfer the toner image from the image carrier onto a recording medium conveyed through the transfer nip, the transfer bias generator including:

a transfer bias supply operatively connected to the second rotary body to supply the transfer bias including at least the alternating current component thereto; and a controller operatively connected to the transfer bias supply to detect a toner adhesion amount at a predetermined region of the image carrier located immediately upstream from the transfer nip and having a predetermined length in the moving direction of the image carrier, the transfer bias generator outputting both the direct current component and the alternating current component under one of constant voltage control and constant current control, and separately changing a target output value of the alternating current component from a non-zero value to another non-zero value and a target output value of the direct current component from a non-zero value to another non-zero value according to the toner adhesion amount detected by the controller.

7. The image forming apparatus according to claim 6, wherein the transfer bias generator increases the respective target output values of the direct current component and the alternating current component as the toner adhesion amount detected by the controller increases.

8. The image forming apparatus according to claim 6, further comprising a user interface operatively connected to the transfer bias generator to receive input from a user, wherein the transfer bias generator switches between a first mode for outputting the transfer bias including only the direct current component and a second mode for outputting the transfer bias including the alternating current component and the direct current component on the basis of the input from the user received by the user interface.

9. The image forming apparatus according to claim 6, further comprising an information acquisition device operatively connected to the transfer bias generator to acquire information on a degree of irregularity of a surface of the recording medium, wherein the transfer bias generator switches between a first mode for outputting the transfer bias including only the direct current component and a second mode for outputting the transfer bias including the alternating current component and the direct current component on the basis of the information acquired by the information acquisition device.

10. The image forming apparatus according to claim 9, wherein the transfer bias generator changes the target output value of the direct current component according to the toner adhesion amount of the predetermined region detected by the controller in the first mode for outputting the transfer bias including only the direct current component.

11. The image forming apparatus according to claim 6, wherein the transfer bias supply includes:

a first power supply to generate the direct current component; and a second power supply to generate the alternating current component.

12. The image forming apparatus according to claim 6, wherein the transfer bias generator performs constant current control on both the alternating current component and the direct current component, and changes the target output value of the direct current component under constant current control according to a combination of a moving speed of the image carrier and the toner adhesion amount detected by the controller.

13. The image forming apparatus according to claim 6, wherein the transfer bias generator performs constant voltage control on both the alternating current component and the direct current component, and changes a frequency of the alternating current component according to a moving speed of the image carrier.

14. The image forming apparatus according to claim 6, wherein the transfer bias generator performs constant current control on both the alternating current component and the direct current component, and changes a frequency of the alternating current component and the target output value of the alternating current component under constant current control according to a moving speed of the image carrier.

15. The image forming apparatus according to claim 6, further comprising an information acquisition device operatively connected to the transfer bias generator to acquire information on one of an electrical resistance and a thickness of the recording medium, wherein the transfer bias generator outputs both the alternating current component and the direct current component under constant voltage control, and changes the target output value of the direct current component under constant voltage control according to a combination of the information acquired by the information acquisition device and the toner adhesion amount detected by the controller.

16. The image forming apparatus according to claim 6, further comprising an information acquisition device operatively connected to the transfer bias generator to acquire information on a degree of irregularity of a surface of the recording medium, wherein the transfer bias generator outputs both the alternating current component and the direct current component under constant voltage control, and changes the target output value of the alternating current component under constant voltage control according to a combination of the information acquired by the information acquisition device and the toner adhesion amount detected by the controller.

17. The image forming apparatus according to claim 6, further comprising a thermo-hygro sensor operatively connected to the transfer bias generator to detect one of a temperature and a humidity of an environment where the image forming apparatus is located, wherein the transfer bias generator outputs both the alternating current component and the direct current component under constant voltage control, and changes the respective target output values of the direct current component and the alternating current component under constant voltage control according to a combination of the one of the temperature and humidity detected by the thermo-hygro sensor and the toner adhesion amount detected by the controller.

18. An image forming apparatus comprising:

an image carrier movable in a predetermined moving direction and to carry a toner image;

a first rotary body to contact an outer surface of the image carrier;

a second rotary body pressed against an inner surface of the image carrier to form a transfer nip between the outer surface of the image carrier and the first rotary body; and a transfer bias generator to output to the second rotary body a transfer bias including a direct current component and an alternating current component for application to the image carrier to transfer the toner image from the image carrier onto a recording medium conveyed through the transfer nip, the transfer bias generator including:

a transfer bias supply operatively connected to the second rotary body to supply the transfer bias including at least the alternating current component thereto; and a controller operatively connected to the transfer bias supply to detect a toner adhesion amount at a predetermined region of the image carrier located immediately upstream from the transfer nip and having a predetermined length in the moving direction of the image carrier, the transfer bias generator outputting both the direct current component and the alternating current component under one of constant voltage control and constant current control, and changing a target output value of the alternating current component and a target output value of the direct current component according to the toner adhesion amount detected by the controller, wherein the transfer bias generator changes the target output value of the alternating current component prior to changing the target output value of the direct current component.

19. The image forming apparatus according to claim 18, wherein a length of the transfer nip in the moving direction of the image carrier is greater than the length of the predetermined region of the image carrier in the moving direction of the image carrier, and wherein the transfer bias generator changes, upon approach of a trailing edge of the predetermined region to the transfer nip, the target output value of the alternating current component according to the toner adhesion amount detected by the controller, and changes, upon approach of a leading edge of the predetermined region to the transfer nip, the target output value of the direct current component according to the toner adhesion amount detected by the controller.

20. The image forming apparatus according to claim 19, wherein the transfer bias generator outputs the transfer bias having a relation of $f \geq 2/\{(d-L)/v\}$, where f represents a frequency in hertz of the alternating current component, d represents the length in millimeters of the transfer nip in the moving direction of the image carrier, v represents a moving speed in millimeters per second of the image carrier, and L represents the length in millimeters of the predetermined region in the moving direction of the image carrier.

21. An image forming apparatus comprising:

an image carrier movable in a predetermined moving direction and to carry a toner image;

a first rotary body to contact an outer surface of the image carrier;

a second rotary body pressed against an inner surface of the image carrier to form a transfer nip between the outer surface of the image carrier and the first rotary body; and a transfer bias generator to output to the second rotary body a transfer bias including a direct current component and an alternating current component for application to the image carrier to transfer the toner image from the image carrier onto a recording medium conveyed through the transfer nip, the transfer bias generator including:

a transfer bias supply operatively connected to the second rotary body to supply the transfer bias including at least the alternating current component thereto; and a controller operatively connected to the transfer bias supply to detect a toner adhesion amount at a predetermined region of the image carrier located immediately upstream from the transfer nip and having a predetermined length in the moving direction of the image carrier, the transfer bias generator outputting both the direct current component and the alternating current component under one of constant voltage control and constant current control, and changing a target output value of the alternating current component and a target output value of the direct current component according to the toner adhesion amount detected by the controller, wherein the transfer bias generator outputs both the alternating current component and the direct current component under constant voltage control, and changes the respective target output values of the direct current component and the alternating current component under constant voltage control according to the toner adhesion amount detected by the controller only when an image area ratio of the predetermined region of the image carrier exceeds approximately 100 percent.

22. An image forming apparatus comprising:

an image carrier movable in a predetermined moving direction and to carry a toner image;

a first rotary body to contact an outer surface of the image carrier;

a second rotary body pressed against an inner surface of the image carrier to form a transfer nip between the outer surface of the image carrier and the first rotary body; and a transfer bias generator to output a transfer bias including a direct current component and an alternating current component for application to the image carrier to transfer the toner image from the image carrier onto a recording medium conveyed through the transfer nip, the transfer bias generator including:

a transfer bias supply operatively connected to one of the first rotary body and the second rotary body to supply the transfer bias thereto, including:

a first power supply to generate the direct current component for supply to one of the first rotary body and the second rotary body; and a second power supply to generate the alternating current component for supply to the other one of the first rotary body and the second rotary body; and a controller operatively connected to the transfer bias supply to detect a toner adhesion amount at a predetermined region of the image carrier located immediately upstream from the transfer nip and having a predetermined length in the moving direction of the image carrier, the transfer bias generator outputting at least the alternating current component under one of constant voltage control and constant current control, and changing a target output value of the alternating current component separately from the direct current component from a non-zero value to another non-zero value according to the toner adhesion amount detected by the controller.

* * * * *